US009599955B2

(12) United States Patent
Hirukawa et al.

(10) Patent No.: US 9,599,955 B2
(45) Date of Patent: Mar. 21, 2017

(54) DEVELOPER STORAGE UNIT, DEVELOPMENT DEVICE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kuniaki Hirukawa, Susono (JP); Akihiro Fujiwara, Mishima (JP); Yu Fukasawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/030,495

(22) Filed: Sep. 18, 2013

(65) Prior Publication Data

US 2014/0079416 A1 Mar. 20, 2014

(30) Foreign Application Priority Data

Sep. 20, 2012 (JP) ..... 2012-207519

(51) Int. Cl.
*G03G 15/08* (2006.01)
*G03G 21/16* (2006.01)

(52) U.S. Cl.
CPC ..... *G03G 21/1676* (2013.01); *G03G 15/0862* (2013.01); *G03G 2215/0132* (2013.01); *G03G 2215/0897* (2013.01)

(58) Field of Classification Search
USPC ..... 399/27, 30, 258, 263
See application file for complete search history.

(56) References Cited

U.S. PATENT DOCUMENTS

| | | | | |
|---|---|---|---|---|
| 4,338,880 | A * | 7/1982 | Tabuchi et al. | 399/103 |
| 2005/0031359 | A1* | 2/2005 | Ishii | 399/12 |
| 2009/0297178 | A1* | 12/2009 | Kakuta et al. | 399/27 |

FOREIGN PATENT DOCUMENTS

| | | | |
|---|---|---|---|
| JP | 2001-318524 | A | 11/2001 |
| JP | 2002-341635 | A | 11/2002 |
| JP | 2005-257934 | A | 9/2005 |
| JP | 2010-009021 | A | 1/2010 |

OTHER PUBLICATIONS

JP2005257934A JPO English machine translation.*

* cited by examiner

*Primary Examiner* — Minh Phan
(74) *Attorney, Agent, or Firm* — Canon U.S.A. Inc., IP Division

(57) ABSTRACT

A developer storage unit includes a receiving portion which is provided on a rotating shaft, and configured to receive a developer falling from a conveyance member.

32 Claims, 17 Drawing Sheets

DEVELOPER STORAGE UNIT, DEVELOPMENT DEVICE, PROCESS CARTRIDGE, AND ELECTROPHOTOGRAPHIC IMAGE FORMING APPARATUS

BACKGROUND OF THE INVENTION

Field of the Invention

The present invention relates to a developer storage unit to be used in an electrophotographic image forming apparatus, a development device including the developer storage unit, a process cartridge, and the electrophotographic image forming apparatus.

Here, the electrophotographic image forming apparatus is an apparatus for forming an image on a recording material by employing electrophotographic image forming processing. The electrophotographic image forming apparatus includes, for example, a copying machine, a printer (a laser beam printer, a light-emitting diode (LED) printer, or the like), a facsimile apparatus, a word processor, or the like.

The developer storage unit is a unit for storing a developer to be used in the electrophotographic image forming processing, and includes a developer storage chamber for storing the developer, a stirring-conveying unit for stirring and conveying the developer stored in the developer storage chamber, and the like.

The development device is a device for visualizing an electrostatic image on an electrophotographic photosensitive member (photosensitive member) using the developer in the electrophotographic image forming processing.

In general, the process cartridge is a unit which is formed by integrating a photosensitive member into a process unit operating on the photosensitive member as a cartridge and detachably mounted on the apparatus main body of the electrophotographic image forming apparatus. A charging unit, a development unit, and a cleaning unit can be given as the examples of the process units. In an exemplary embodiment of the present invention, the process cartridge is a unit configured by integrally forming the photosensitive member and at least the development device into a cartridge, and detachably mounted on the apparatus main body of the electrophotographic image forming apparatus.

Description of the Related Art

Conventionally, as a method for filling a developer storage chamber with a developer, a method in which a filling port for supplying the developer is provided on a frame forming the developer storage chamber, and the filling port is sealed with a sealing member such as a cap after the developer is supplied through the filling port has been widely employed.

However, with the above-described method, because the sealing member has to be provided separately, this method may cause an increase in number of components and an increase in number of steps in assembly processing. In addition, in many cases, a rotatable conveyance unit as a stirring-conveying unit for stirring and conveying the developer is provided within the developer storage chamber. In this case, depending on the phase of the conveyance unit stopped within the developer storage chamber, a conveyance member such as a sheet attached to a rotating shaft of the conveyance unit may interrupt the filling of the developer through the filling port. Therefore, there may be a case where the attachment phase of the conveyance unit has to be controlled.

With respect to the above issue, a method in which a hollow space is provided within the conveyance unit to supply the developer via the hollow space has been discussed (Japanese Patent Application Laid-Open No. 2002-341635).

In this method, a hole previously provided on a frame, through which a drive transmission member such as a drive transmission gear for transmitting a driving force to the conveyance unit is inserted within the developer storage chamber, is used as a filling port, so that the developer is supplied through the filling port by accessing the conveyance unit. After the developer has been filled, the filling port is sealed with an existing sealing member that seals a space between the drive transmission member and the frame. Therefore, a dedicated filling port or a dedicated sealing member does not have to be provided separately, and thus the number of components or the number of steps in assembly processing can be reduced. In addition, because the developer is filled via the interior of the conveyance unit, the conveyance member attached to the rotating shaft of the conveyance unit is less likely to interrupt the developer that is being filled, and thus the filling efficiency of the developer can be further improved.

Conventionally, in the image forming apparatus employing the electrophotographic image forming processing, a cartridge system has been employed. In the cartridge system, a developer storage unit or a development device formed into a cartridge, or a cartridge such as a process cartridge is detachably mounted on the apparatus main body of the image forming apparatus.

In the above-described cartridge system, in order to enable a user to replace the cartridge at an appropriate timing, a function of displaying information about remaining printable pages may be added. In order to add the above function, in general, the remaining amount of the developer within the cartridge is detected or estimated, and thus various methods therefor are discussed.

Of the various methods therefor, a light transmission-type developer remaining amount detection method has been widely employed. In this method, a light guiding member as a remaining amount detection unit including a light guide and a light transmission window is provided on the developer storage chamber. Further, a light path passing through the developer storage chamber via the light guiding member is formed by a light emitting element such as a light-emitting diode (LED) and a light receiving element such as a phototransistor which are mounted on the apparatus main body of the electrophotographic image forming apparatus. Then, the remaining amount of the developer is detected from a period of time in which the developer blocks the light path (Japanese Patent Application Laid-Open No. 2001-318524).

However, in the above-described light transmission-type developer remaining amount detection method, the developer that is stirred and conveyed by the conveyance unit may scatter within the developer storage chamber, and thus the scattered developer may block a light signal. In this case, disturbances may occur in a light receiving signal, so that detection accuracy of the developer remaining amount may be deteriorated.

With respect to the above-described issue, a method in which a receiving portion for receiving the developer falling from the conveyance member is provided on a rotating shaft within the developer storage chamber to suppress the scattering of developer has been discussed (Japanese Patent Application Laid-Open No. 2010-009021).

In order to fill the developer storage unit having such a complicated structure with the developer, further technical development has been required.

SUMMARY OF THE INVENTION

The present invention relates to a developer storage unit capable of filling a developer via an interior of a rotating shaft disposed within a developer storage chamber, a development device, a process cartridge, and an electrophotographic image forming apparatus.

According to an aspect of the present invention, a developer storage unit includes a frame configured to form a developer storage chamber for storing a developer, a rotating shaft which is provided on an interior of the developer storage chamber in a rotatable manner and includes a hollow portion formed in an interior thereof and a side opening communicating between the hollow portion and an outside surface thereof in a turning radius direction thereof, a detection unit which is provided on an inner wall surface of the developer storage chamber arranged on an outside in the turning radius direction of the rotating shaft, and configured to detect an amount of a developer in the interior of the developer storage chamber, a conveyance member which is provided on the rotating shaft, and configured to stir and convey the developer stored in the developer storage chamber by rotation of the rotating shaft, and a receiving portion which is provided on the rotating shaft, and configured to receive a developer falling from the conveyance member.

Further, according to another aspect of the present invention, there are provided a development device, a process cartridge, and an electrophotographic image forming apparatus including the developer storage unit according to the present invention.

Further features of the present invention will become apparent from the following description of exemplary embodiments with reference to the attached drawings.

DESCRIPTION OF THE EMBODIMENTS

Hereinbelow, a developer storage unit, a development device, a process cartridge, and an electrophotographic image forming apparatus according to an exemplary embodiment of the present invention will be described further in detail with reference to the drawings.

Figure 1:
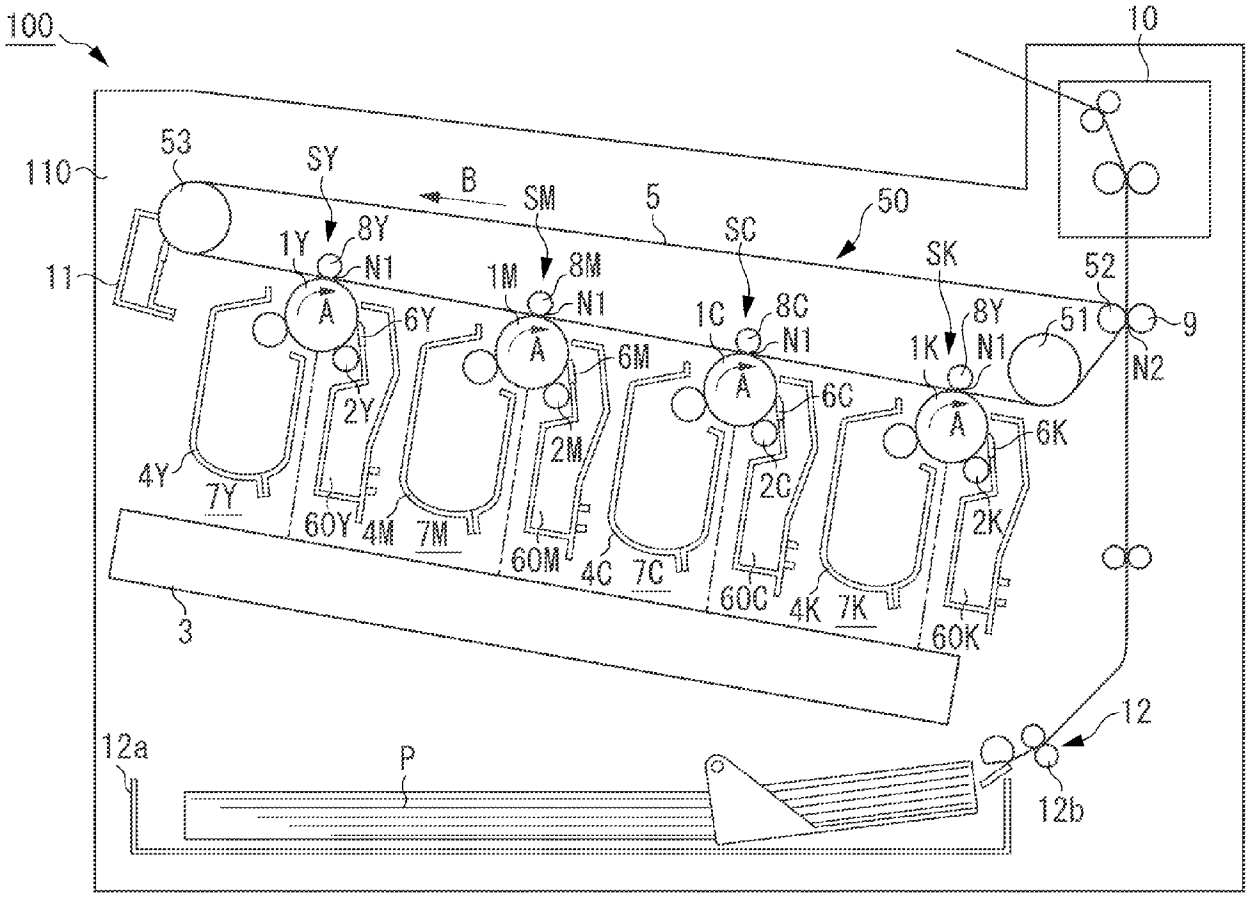
FIG. 1 is a schematic cross-sectional view of an image forming apparatus according to an exemplary embodiment of the present invention.

1. General Configuration and Operation of Electrophotographic Image Forming Apparatus First, a general configuration and operations of the electrophotographic image forming apparatus according to the exemplary embodiment of the present invention will be described. FIG. 1 is a schematic cross-sectional view of an electrophotographic image forming apparatus 100 according to the present exemplary embodiment.

The electrophotographic image forming apparatus 100 according to the present exemplary embodiment is a full-color laser beam printer employing an in-line system and an intermediate transfer system. According to image information, the electrophotographic image forming apparatus 100 can form a full-color image on a recording material (recording medium) such as a recording paper, a plastic sheet, or a fabric. The image information is input to an apparatus main body 110 from an image reading device connected to the apparatus main body 110 of the electrophotographic image forming apparatus 100 or a host device such as a personal computer communicably connected to the apparatus main body 110.

As a plurality of image forming units, the electrophotographic image forming apparatus 100 includes a first, a second, a third, and a fourth image forming units SY, SM, SC, and SK for forming images in respective colors of yellow (Y), magenta (M), cyan (C), and black (K). According to the present exemplary embodiment, the first through the fourth image forming units SY, SM, SC, and SK are arranged in a row in a direction intersecting with a vertical direction.

According to the present exemplary embodiment, the configurations and operations of the first through the fourth image forming units SY, SM, SC, and SK are substantially the same except for the colors of toners used as developers.

Accordingly, unless the first through the fourth image forming units have to be distinguished from each other, description thereof will be collectively given by omitting the trailing symbols Y, M, C, and K that indicate the elements provided for the respective colors.

An image forming unit S includes a photosensitive drum 1 which is a drum-shape electrophotographic photosensitive member (photosensitive member) serving as an image bearing member. The four photosensitive drums 1 respectively provided on the image forming units SY, SM, SC, and SK, are arranged in a direction intersecting with the vertical direction. The photosensitive drum 1 is rotationally driven in a direction indicated by an arrow A (clockwise direction) in FIG. 1 by a driving motor as a drive unit (driving source) which is not illustrated in FIG. 1.

Each of the following units is arranged in the periphery of the photosensitive drum 1. A charging roller 2 is a roller-shape charging member serving as a charging unit which uniformly charges a surface of the photosensitive drum 1. A scanner unit (exposure device or optical system) 3 is an exposure unit for forming an electrostatic image (electrostatic latent image) on the photosensitive drum 1 by irradiating the photosensitive drum 1 with laser light based on image information. A development device (development unit) 4 includes a developing unit for developing the electrostatic image formed on the photosensitive drum 1 into a toner image. A transfer device 50 transfers the toner image formed on the photosensitive drum 1 to a recording material P. A cleaning device 60 serves as a cleaning unit for removing the toner remaining on the surface of the photosensitive drum 1 after the image transfer.

The transfer device 50 includes an intermediate transfer belt 5 as an intermediate transfer member arranged facing to the four photosensitive drums 1. The intermediate transfer belt 5 is an endless belt which circulates and moves (rotates) in a direction indicated by an arrow B (counter clockwise direction) in FIG. 1 while contacting with all of the four photosensitive drums 1. The intermediate transfer belt 5 is stretched upon a plurality of supporting members such as a drive roller 51, a secondary transfer counter roller 52, and a driven roller 53. On the side of an inner circumferential surface of the intermediate transfer belt 5, four primary transfer rollers 8 which are roller-shape primary transfer members serving as primary transfer units are arranged facing to the respective photosensitive drums 1. The primary transfer roller 8 presses the intermediate transfer belt 5 against the photosensitive drum 1 to form a nip (primary transfer nip) at a primary transfer portion N1 where the intermediate transfer belt 5 contacts with the photosensitive drum 1. Then, bias in the opposite polarity of the normal charging polarity of the toner is applied to the primary transfer rollers 8 from a primary transfer bias power source (high-voltage power source) as a primary transfer bias applying unit which is not illustrated in FIG. 1. With this configuration, toner images on the photosensitive drums 1 are transferred to the intermediate transfer belt 5 (primary transfer). On the side of an outer circumferential surface of the intermediate transfer belt 5, a secondary transfer roller 9 which is a roller-shape secondary transfer member serving as a secondary transfer unit is arranged at a position facing to the secondary transfer counter roller 52. The secondary transfer roller 9 presses the intermediate transfer belt 5 against the secondary transfer counter roller 52 to form a nip (secondary transfer nip) at a secondary transfer portion N2 where the intermediate transfer belt 5 contacts with the secondary transfer roller 9. Then, bias in the opposite polarity of the normal charging polarity of the toner is applied to the secondary transfer roller 9 from a secondary transfer bias power source (high-voltage power source) as a secondary transfer bias applying unit which is not illustrated in FIG. 1. With this configuration, toner images on the intermediate transfer belt 5 are transferred to the recording material P (secondary transfer).

In addition, the electrophotographic image forming apparatus 100 includes a recording material supplying device for supplying the recording material P to the secondary transfer portion N2, and a fixing device 10 as a fixing unit for fixing a toner image on the recording material P on a downstream side of the secondary transfer portion N2 in a conveyance direction of the recording material P.

According to the present exemplary embodiment, the development unit 4 uses a toner that is a non-magnetic one-component developer as a developer. Further, according to the present exemplary embodiment, the development unit 4 executes development of an electrostatic image by causing a development roller 17 (see FIG. 2) as a developer carrying member to contact with the photosensitive drum 1. Furthermore, according to the present exemplary embodiment, the development unit 4 executes development of the electrostatic image through reversal development in which the toner charged with a polarity same as the charging polarity of the photosensitive drum 1 (negative polarity in the present exemplary embodiment) is adhered to a portion (image portion or exposed portion) where an absolute value of the potential is lowered due to exposure of the photosensitive drum 1.

According to the present exemplary embodiment, the photosensitive drum 1, the charging roller 2 as a process unit operating on the photosensitive drum 1, the development unit 4, and the cleaning device 60 are integrally formed into a cartridge to form a process cartridge 7. The process cartridge 7 is detachably mounted on the apparatus main body 110 with mounting units such as a mounting guide and a positioning member provided on the apparatus main body 110.

When an image is formed, firstly, a surface of the photosensitive drum 1 is uniformly charged by the charging roller 2. Then, a scanner unit 3 emits laser light (information light) according to image information, so that the charged surface of the photosensitive drum 1 is scanned with and exposed to the laser light. Through the operation, an electrostatic image according to the image information is formed on the photosensitive drum 1. Then, the electrostatic image formed on the photosensitive drum 1 is developed to a toner image by the development unit 4. The toner image formed on the photosensitive drum 1 is primarily transferred onto the intermediate transfer belt 5 as a transfer member by the operation of the primary transfer roller 8.

For example, when a full-color image is formed, the above-described processing is sequentially executed on the first through the fourth image forming units SY, SM, SC, and SK, so that the toner images in respective colors are sequentially overlapped with each other and primarily transferred onto the intermediate transfer belt 5.

Then, in synchronization with the movement of the toner images formed on the intermediate transfer belt 5, a recording material P is conveyed to the secondary transfer portion N2 by a conveyance roller 12*b*, from a recording material cassette 12*a* of a recording material supplying device 12 which configures the conveyance unit for conveying the recording material P. Through the operation of the secondary transfer roller 9 which contacts with the intermediate transfer belt 5 via the recording material P, the toner images in four colors transferred on the intermediate transfer belt 5 are secondarily transferred to the recording material P as a transfer member in a collective manner.

The recording material P on which the toner images are transferred is conveyed to the fixing device 10. In the fixing device 10, heat and pressure are applied to the recording material P, so that the toner images are fixed to the recording material P. Then, the recording material P is discharged to the outside of the apparatus main body 110.

A primary transfer residual toner remaining on the photosensitive drum 1 after the primary transfer processing is cleaned by the cleaning device 60. The cleaning device 60 collects the primary transfer residual toner that is removed from the surface of the rotating photosensitive drum 1 by a cleaning member 6 (see FIG. 2) and stores it in a removed toner chamber 14*a* (see FIG. 2). In addition, a secondary transfer residual toner remaining on the intermediate transfer belt 5 after the secondary transfer processing is cleaned by an intermediate transfer belt cleaning device 11.

The electrophotographic image forming apparatus 100 can form a single color image or a multi-color image using a desired single image forming unit or a plurality of desired image forming units.

2. Process Cartridge

Figure 2:
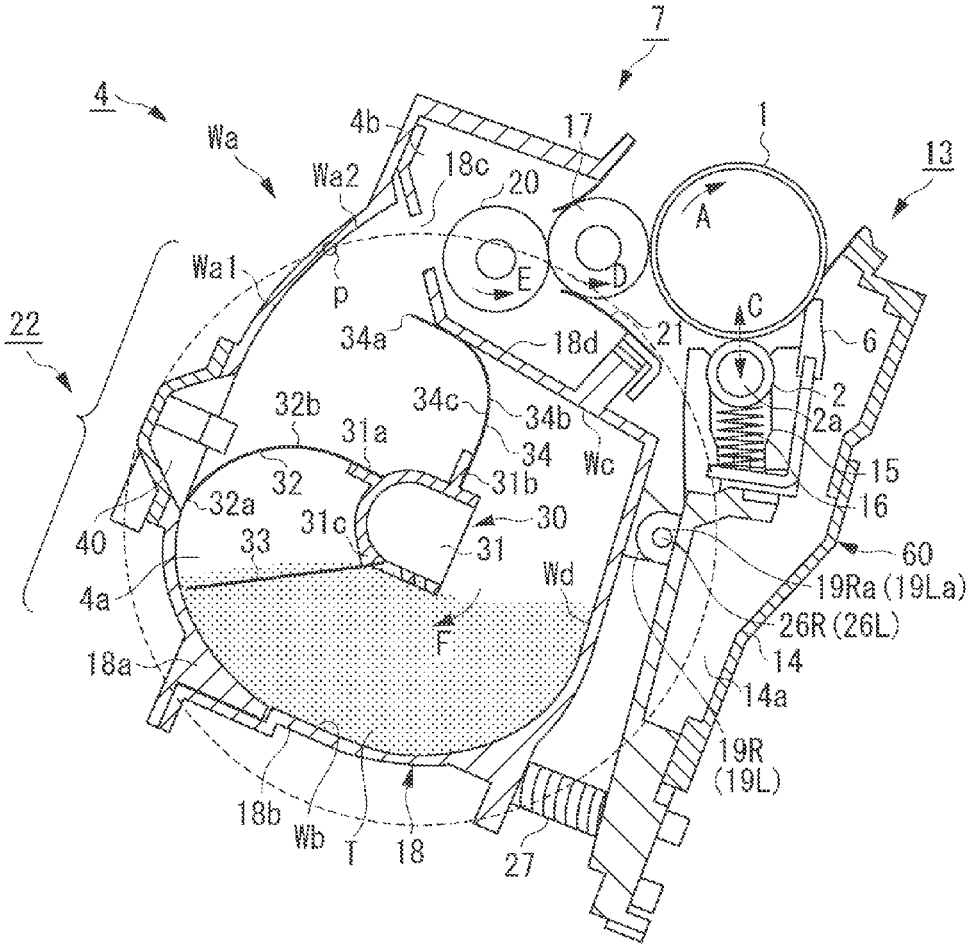
FIG. 2 is a longitudinal sectional view of a process cartridge according to the exemplary embodiment of the present invention.

Next, the process cartridge 7 according to the present exemplary embodiment will be described further. FIG. 2 is a longitudinal sectional view of the process cartridge 7 mounted on the apparatus main body 110.

According to the present exemplary embodiment, a cartridge 7Y storing a yellow toner, a cartridge 7M storing a magenta toner, a cartridge 7C storing a cyan toner, and a cartridge 7K storing a black toner have substantially the same configuration.

The process cartridge 7 can be divided into a photosensitive member unit 13 and a development unit 4. Each of the units will be described below.

The photosensitive member unit 13 includes the photosensitive drum 1, the charging roller 2, and the cleaning device 60. The photosensitive member unit 13 is integrated by a cleaning frame 14 serving as a frame. The cleaning device 60 includes the cleaning member (cleaning blade) 6, and the removed toner chamber 14*a* formed by the cleaning frame 14. The photosensitive drum 1 is supported by the cleaning frame 14 in a rotatable manner via a bearing that is not illustrated in FIG. 2. Then, a driving force of a driving motor as a driving unit (not illustrated) provided on the apparatus main body 110 is transmitted to the photosensitive drum 1, so that the photosensitive drum 1 is rotationally driven in a direction indicated by an arrow A (clockwise direction) in FIG. 2 according to the image forming operation. The charging roller 2 and the cleaning member 6 are respectively arranged to contact with the outer circumferential surface of the photosensitive drum 1. The primary transfer residual toner removed from the surface of the photosensitive drum 1 by the cleaning member 6 falls into the removed toner chamber 14*a*.

A charging roller bearing 15 is attached to the cleaning frame 14 so as to be movable in a direction indicated by an arrow C in FIG. 2, which is a direction along a straight line passing through the rotational center of the charging roller 2 and the rotational center of the photosensitive drum 1. A rotating shaft 2*a* of the charging roller 2 is supported by the cleaning frame 14 in a rotatable manner via the charging roller bearing 15. Then, the charging roller bearing 15 is applied a pressure toward the photosensitive drum 1 by a charging roller pressure member 16.

The development unit 4 is integrated by a development frame 18 serving as a frame. The development frame 18 forms a developer storage chamber 4*a* and a development chamber 4*b*. A toner T as a developer is stored in the developer storage chamber 4*a*, and a rotating shaft 31, a conveyance member 32, a cleaning member 33, and a receiving member 34 are arranged therein. The development roller 17 as a developer carrying member, a supply roller 20 as a developer supply member, and a development blade 21 as a developer regulating member are arranged in the development chamber 4*b*. The developer storage chamber 4*a* and the development chamber 4*b* are separated by a partition wall 18*d* formed by the development frame 18. The partition wall 18 forms a part of inner wall surfaces of the developer storage chamber 4*a* and the development chamber 4*b*.

According to the present exemplary embodiment, in an orientation in which the process cartridge 7 is mounted on the apparatus main body 110, the development chamber 4*d* is arranged on the upper side of the developer storage chamber 4*a*. The developer storage chamber 4*a* and the development chamber 4*b* are communicated with each other through an opening portion 18*c* provided on the partition wall 18*d* that separates the developer storage chamber 4*a* and the development chamber 4*b*. In other words, according to the present exemplary embodiment, in the above-described orientation, the opening portion 18*c* which communicates between the developer storage chamber 4*a* and the development chamber 4*b* is arranged on the upper side of the developer storage chamber 4*a*.

The development roller 17 is supported at both end portions thereof in a rotational axial direction by the development frame 18 in a rotatable manner via bearings (not illustrated) which are respectively attached to the development frame 18. The development roller 17 is arranged so as to contact with the outer circumferential surface of the photosensitive drum 1. A driving force of the driving motor as the driving unit (not illustrated) provided on the apparatus main body 110 is transmitted to the development roller 17, so that the development roller is rotationally driven in a direction indicated by an arrow D (counter-clockwise direction) in FIG. 2. In other words, the photosensitive drum 1 and the development roller 17 are rotationally driven, so that the respective surfaces thereof are moved in a forward direction at a contact portion.

The supply roller 20 and the development blade 21 are respectively arranged to contact with the outer circumferential surface of the development roller 17. A driving force of the driving motor as the driving unit (not illustrated) provided on the apparatus main body 110 is transmitted to the supply roller 20, so that the supply roller 20 is rotationally driven in a direction indicated by an arrow E (counter-clockwise direction) in FIG. 2. In other words, the development roller 17 and the supply roller 20 are rotationally driven, so that the respective surfaces thereof are moved in the opposite direction at a contact portion. In addition to supplying the toner to the development roller 17, the supply roller 20 scrapes off the toner, which has been carried by the development roller 17 and returned to the development chamber 4*b* without being used for development, from the development roller 17. The development blade 21 contacts with the surface of the development roller 17 further on the downstream side than a contact portion of the development roller 17 and the supply roller 20 in the rotational direction of the development roller 17. The development blade 21 regulates the amount of the toner that has been supplied to the development roller 17 by the supply roller 20, and rubs the toner against the surface of the development roller 17 to cause the toner to be frictionally charged.

According to the present exemplary embodiment, the development roller 17, the supply roller 20, the development blade 21, and the like form the developing unit for developing an electrostatic image on the electrophotographic photosensitive member.

The rotating shaft 31 is provided on the developer storage chamber 4*a* in a rotatable manner. The rotating shaft 31 is supported on both end portions in the axial direction thereof by the development frame 18 in a rotatable manner. A driving force of the driving motor as the driving unit (not illustrated) provided on the apparatus main body 110 is transmitted to the rotating shaft 31, so that the rotating shaft 31 is rotationally driven in a direction indicated by an arrow F (clockwise direction) in FIG. 2.

The rotating shaft 31 is provided with the conveyance member 32 which supplies a toner from the developer storage chamber 4*a* to the development chamber 4*b* via the opening portion 18*c* provided on the partition wall 18*d* by stirring and conveying the toner stored within the developer storage chamber 4*a*. The rotating shaft 31 is further provided with the cleaning member 33 and the receiving member 34. The rotating shaft 31 and attachment components thereof such as the conveyance member 32, the cleaning member 33, and the receiving member 34, form the conveyance unit 30 as a stirring-conveying unit which stirs and conveys the developer stored in the developer storage chamber 4*a*. Configurations and operations of the rotating shaft 31 and the attachment components thereof will be described below further in detail.

The developer storage chamber 4*a* is also provided with a detection unit 40 as a remaining amount detection unit for detecting an amount of the toner within the developer storage chamber 4*a*. In the rotational direction of the rotating shaft 31, the detection unit 40 is disposed on an inner wall surface (first side wall surface) Wa further on the upstream side than the opening portion 18*c* and further on the downstream side than an inner wall surface (bottom wall surface) Wb that forms a bottom portion of the developer storage chamber 4*b*. In other words, the detection unit 40 is disposed on the inner wall surface of the developer storage chamber 4*a* which is arranged on the outside in a turning radius direction of the rotating shaft 31. In addition, according to the present exemplary embodiment, the detection unit 40 is disposed on an almost central portion in the axial direction of the rotating shaft 31 (i.e., the longitudinal direction of the developer storage chamber 4*a*). Further, according to the present exemplary embodiment, this detection unit 40 serves as a light guiding member (light transmission member) 40 which executes light transmission-type developer remaining amount detection. The light transmission-type developer remaining amount detection executed by the light guiding member 40 will be described below.

According to the present exemplary embodiment, the developer storage chamber 4*a* formed of the development frame 18, the rotating shaft 31, the conveyance member 32, the cleaning member 33, the receiving member 34, and the detection unit 40 form a developer storage unit 22. According to the present exemplary embodiment, the developer storage unit 22 is integrated with the development chamber 4*b* and the developing unit supported by the development chamber 4*b* as the development unit 4 by the development frame 18.

According to the present exemplary embodiment, the developer storage chamber 4*a* and the development chamber 4*b* are formed integrally by the development frame 18. However, the configuration thereof is not limited thereto, and the developer storage chamber 4*a* and the development chamber 4*b* may be formed on separate frames and subsequently combined to each other.

The development unit 4 is connected to the photosensitive member unit 13 so as to be rotatable about a shaft 26R (26L) that engages with a hole 19Ra (19La) provided on a bearing member 19R (19L). The development unit 4 is biased by a pressure spring 27, so as to rotate in a direction in which the development roller 17 abuts on the photosensitive drum 1 by making the shaft 26R (26L) as a center. With this configuration, at least during the image forming, the development roller 17 contacts with the photosensitive drum 1.

The toner stored in the developer storage chamber 4*a* is supplied to the development chamber 4*b*, and the supply roller 20 and the development blade 21 form a predetermined thickness of a toner layer on the surface of the development roller 17. Then, the toner on the toner layer is transferred to the photosensitive drum 1 according to the electrostatic image formed on the photosensitive drum 1. Through this operation, a toner image is formed on the photosensitive drum 1. Then, after the primary transfer, the primary transfer residual toner remaining on the photosensitive drum 1 is scraped off by the cleaning member 6 and collected to the removed toner chamber 14*a*. Then, the surface of the photosensitive drum 1 is uniformly charged by the charging roller 2, so that the photosensitive drum 1 is in a state ready for forming an electrostatic image by the scanner unit 3.

3. Conveyance of Toner

Next, an operation of the development unit 4 for conveying the toner will be descried with reference to FIG. 3 through FIG. 6. FIG. 3 through FIG. 6 are longitudinal sectional views of the development unit 4 illustrating the toner conveyance processes.

Hereinbelow, toner supply from the developer storage chamber 4*a* to the development chamber 4*b* will be mainly described. The light transmission-type developer remaining amount detection will be described below. Thus, the cleaning member 33 and the receiving member 34 of the conveyance unit 30 are not illustrated in FIG. 3 through FIG. 6.

Figure 3:
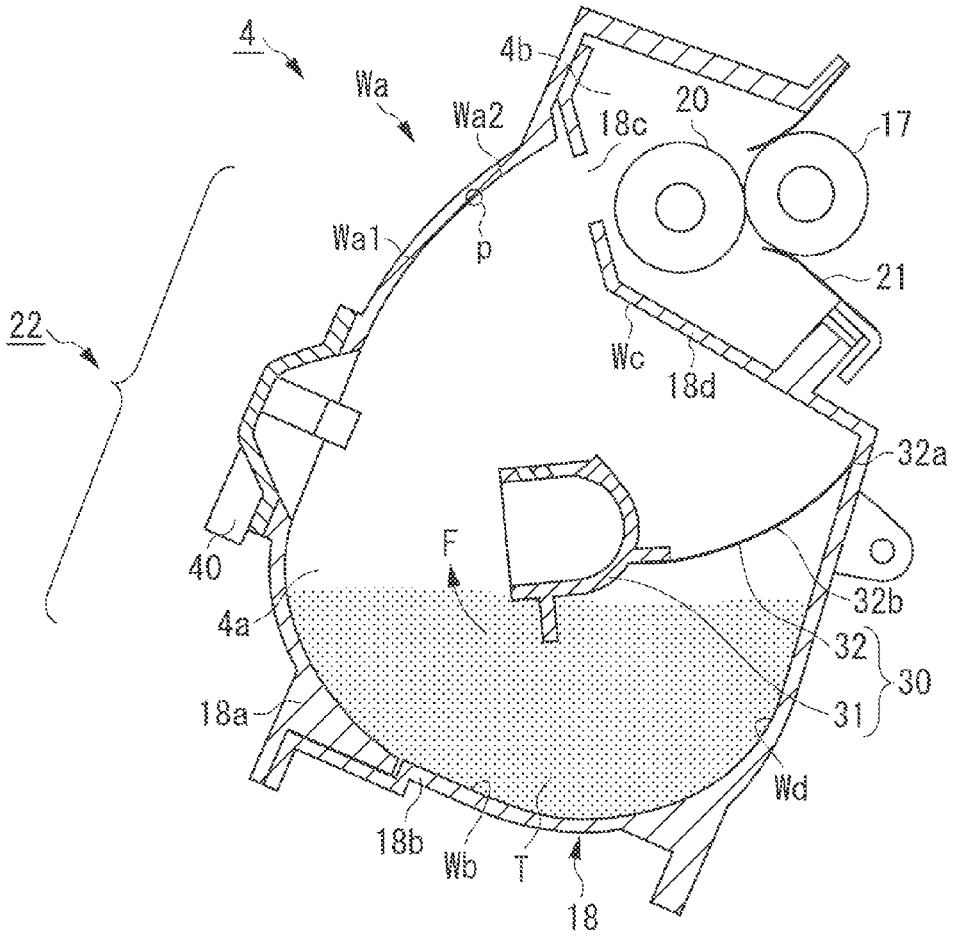
FIG. 3 is a longitudinal sectional view of a development unit illustrating a conveyance process of a developer according to the exemplary embodiment of the present invention.
Figure 4:
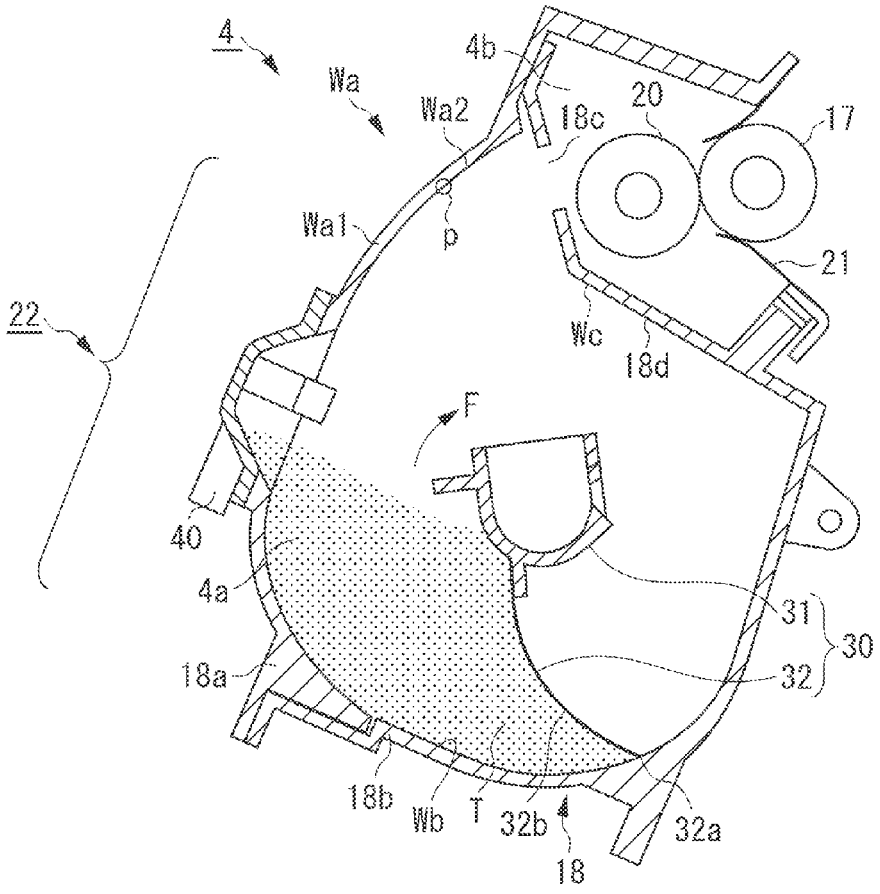
FIG. 4 is a longitudinal sectional view of the development unit illustrating a conveyance process of a developer according to the exemplary embodiment of the present invention.
Figure 5:
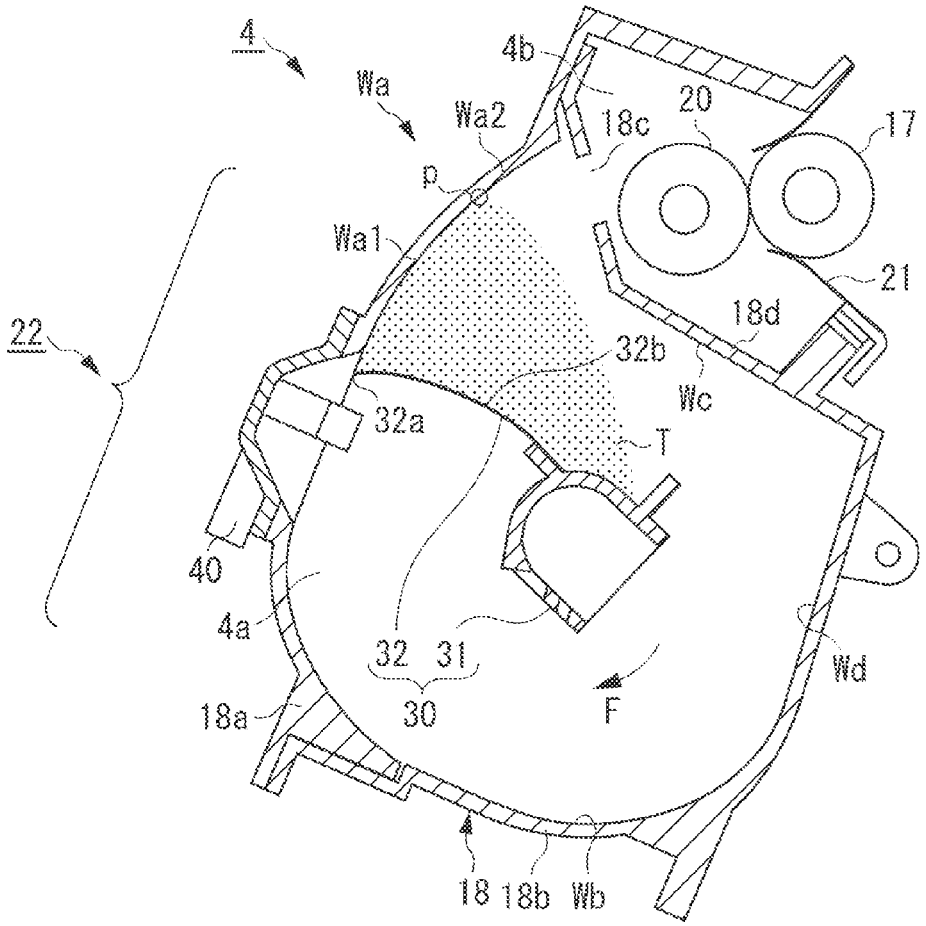
FIG. 5 is a longitudinal sectional view of the development unit illustrating a conveyance process of a developer according to the exemplary embodiment of the present invention.
Figure 6:
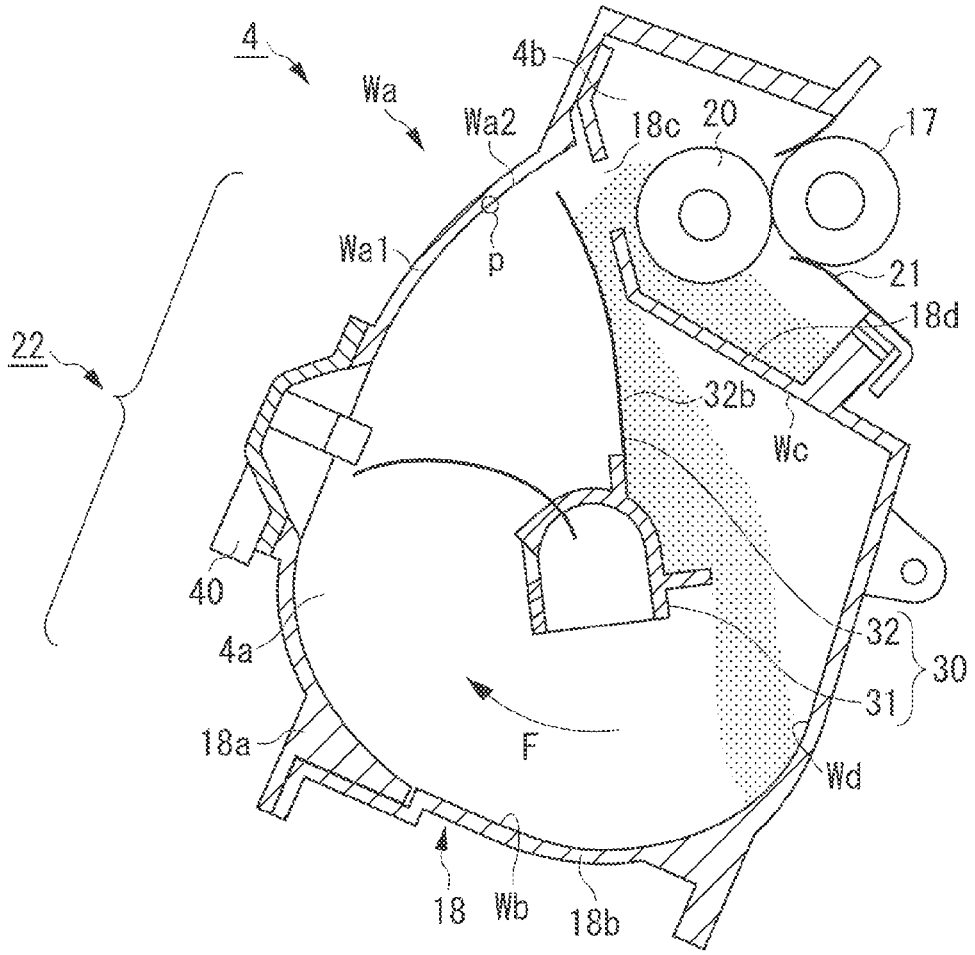
FIG. 6 is a longitudinal sectional view of the development unit illustrating a conveyance process of a developer according to the exemplary embodiment of the present invention.

When the conveyance unit 30 rotates as illustrated in FIG. 4 at the state where the toner T is accumulated at the bottom portion of the developer storage chamber 4*a* as illustrated in FIG. 3, the toner T is pushed and moved by the conveyance member 32. When the conveyance unit 30 further rotates, the toner T is lifted up by the conveyance member 32 as illustrated in FIG. 5, and then a part of the toner T is conveyed to the development chamber 4*b* as illustrated in FIG. 6. Then, the toner T which has not been conveyed to the development chamber 4*b* falls from the conveyance member 32 to accumulate at the bottom portion of the developer storage chamber 4*a*, so that the toner T returns to the state illustrated in FIG. 3. By repeating the above-described sequence of operations, the toner T within the developer storage chamber 4*a* is stirred and supplied to the development chamber 4*b*. As described above, the toner T supplied to the development chamber 4*b* is used by the developing unit to develop the electrostatic image on the photosensitive drum 1. According to the present exemplary embodiment, the development chamber 4*b* serves as a supply target of the developer from the developer storage unit 22.

An operation of the conveyance member 32 will be described further. As the inner wall surfaces formed by the development frame 18, the developer storage chamber 4*a* includes the bottom wall surface Wb and the first side wall surface Wa which is further on the downstream side than the bottom wall surface Wb and further on the upstream side than the opening portion 18*c* (i.e., partition wall 18*d*) in the rotational direction of the rotating shaft 31. In addition, the first side wall surface Wa includes a regulation wall surface Wa1 and a release wall surface Wa2. The regulation wall surface Wa1 contacts with the conveyance member 32. The release wall surface Wa2 is further on the downstream side than the regulation wall surface Wa1 and further on the upstream side than the opening portion 18*c* (i.e., partition wall 18*d*) in the rotational direction of the rotating shaft 31, and does not contact with the conveyance member 32. The regulation wall surface Wa1 continues to the release wall surface Wa2 at a boundary point p.

In the orientation in which the process cartridge 7 is mounted on the apparatus main body 110, the first side wall surface Wa is positioned on the upper side of the bottom wall surface Wb, whereas the release wall surface Wa2 is positioned on the upper side of the regulation wall surface Wa1. Further, in the same orientation, the boundary point p between the regulation wall surface Wa1 and the release wall surface Wa2 is disposed on the upper side of the light guiding member 40. According to the present exemplary embodiment, in the same orientation, the opening portion 18*c* is disposed upside of the rotating shaft 31, and on a plane that passes through the rotational center of the rotating shaft 31 to extend in the vertical direction, or further on the side of the first side wall surface Wa than that plane. Furthermore, according to the present exemplary embodiment, in the same orientation, an upper edge portion of the opening portion 18*c* is arranged to become adjacent to a connection portion of the partition wall 18*d* and the first side wall surface Wa.

The conveyance member 32 contacts with the bottom wall surface Wb and the regulation wall surface Wa1. Then, the conveyance member 32 rotates according to the rotation of the rotating shaft 31 to rub against the bottom wall surface Wb and the regulation wall surface Wa1, so as to be deformed by being biased against the elastic force of the conveyance member 32. Further, according to the rotation of the rotating shaft 31, the conveyance member 32 rotates while contacting with the bottom wall surface Wb and the regulation wall surface Wa1, so as to carry and convey the toner T to a bearing surface 32*b* that is a surface on the downstream side in the rotational direction thereof. Then, according to the rotation of the rotating shaft 31, when a leading edge 32*a* on a free end side of the conveyance member 32 reaches the release wall surface Wa2, the contact between the conveyance member 32 and the first side wall surface Wa of the developer storage chamber 4*a* is released. When the contact between the conveyance member 32 and the first side wall surface Wa of the developer storage chamber 4*a* is released, the conveyance member 32 intends to change the shape into a shape in a natural state (original shape before deformed) by its own elastic restoration force. Due to the change in shape of the conveyance member 32 in the restoration direction, the toner T carried and conveyed by the bearing surface 32*b* of the conveyance member 32 is flipped up against the gravitational force, toward the opening portion 18*c* further on the downstream side than the release wall surface Wa2 in the rotational direction of the rotating shaft 31.

The configuration of the conveyance member 32 will be described further. On a conveyance member attachment surface 31*a* provided on an outer surface of the rotating shaft 31, the conveyance member 32 is attached to an almost entire region thereof in the axial direction (longitudinal direction) of the rotating shaft 31. The conveyance member 32 is a rectangular-shape sheet member that can be produced from a flexible resin sheet such as a polyester film, a polyphenylene sulfide film, or a polycarbonate film having a thickness of 50 μm to 250 μm. The end portion of the conveyance member 32 on the inside in the turning radius direction of the rotating shaft 31 is attached to the rotating shaft 31. The conveyance member 32 is fixed to the rotating shaft 31 through an appropriate fixing method such as thermal caulking, ultrasonic welding, or adhesive bonding.

The length of the conveyance member 32 in the turning radius direction of the rotating shaft 31 in the natural state is set to be longer than a distance from the rotational center of the rotating shaft 31 to the regulation wall surface Wa1 in the turning radius direction thereof. On the other hand, the length of the conveyance member 32 in the turning radius direction of the rotating shaft 31 in the natural state is shorter than a distance from the rotational center of the rotating shaft 31 to the release wall surface Wa2 in the turning radius direction thereof. Therefore, according to the rotation of the rotating shaft 31, the leading edge 32*a* as an end portion (free end) of the conveyance member 32 on the outside in the turning radius direction of the rotating shaft 31 moves while contacting with the regulation wall surface Wa1. At this time, the conveyance member 32 is warped and deformed against the elastic force of the conveyance member 32, toward the upstream side in the rotational direction of the rotating shaft 31. After passing through the boundary point p, the leading edge 32*a* of the conveyance member 32 does not contact with the release wall surface Wa2, thus the conveyance member 32 is restored to the natural state and the leading edge 32*a* moves toward the opening portion 18*c* in the rotational direction of the rotating shaft 31 using the rotating shaft 31 as a fulcrum. Then, when the rotating shaft 31 rotates further, the conveyance member 32 moves while causing the leading edge 32*a* thereof to contact with an upper wall surface We as an inner wall surface of the partition wall 18*d*, a second side wall surface Wd as an inner wall surface facing to the first side wall surface Wa, and the bottom wall surface Wb. Then, the leading edge 32*a* thereof contacts with the regulation wall surface Wa1 of the first side wall surface Wa again.

4. Configuration of Remaining Amount Detection Unit

Figure 7:
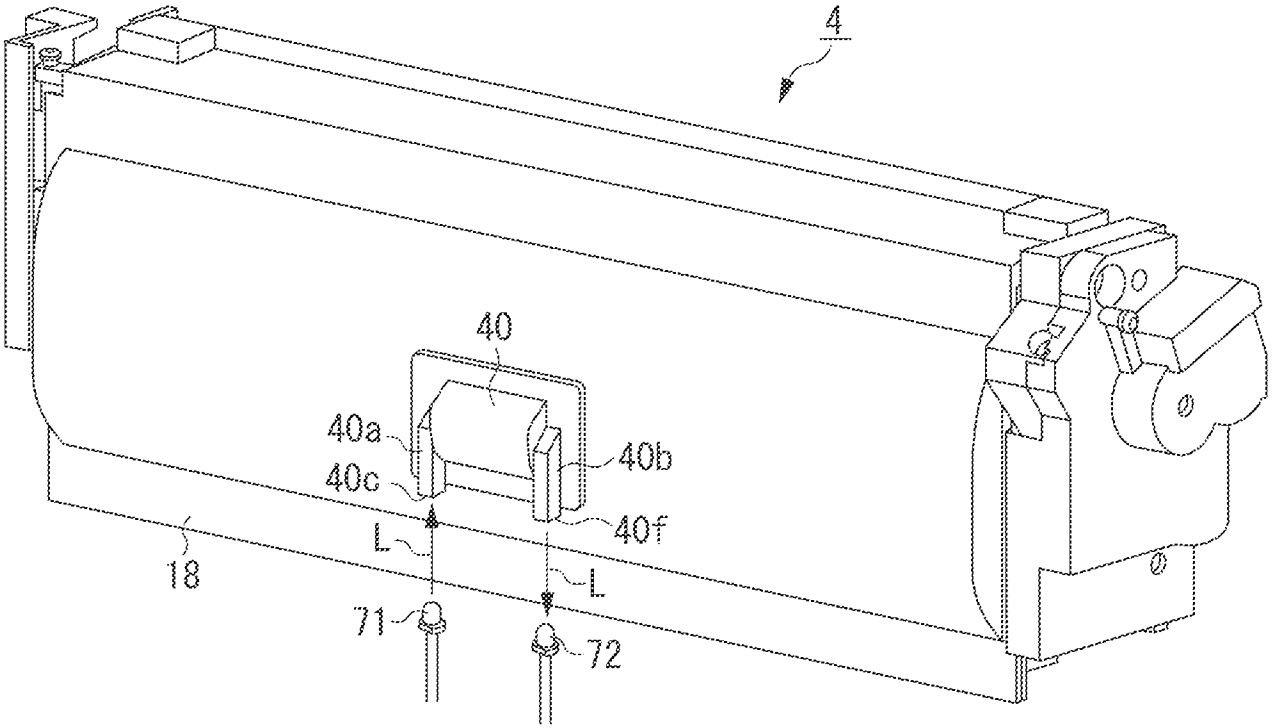
FIG. 7 is a perspective view illustrating a periphery of a remaining amount detection unit according to the exemplary embodiment of the present invention which is seen from the outside of a developer storage chamber.
Figure 8:
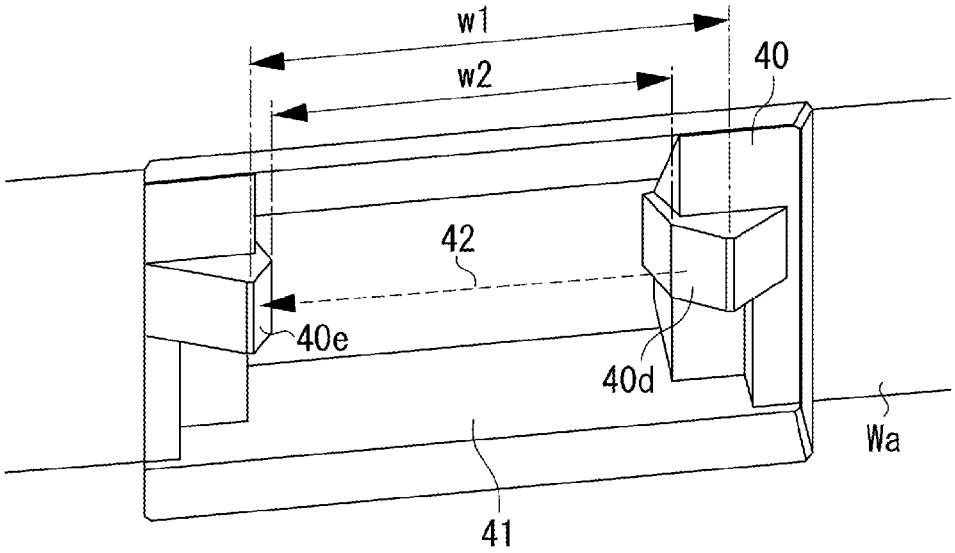
FIG. 8 is a perspective view illustrating the periphery of the remaining amount detection unit according to the exemplary embodiment of the present invention which is seen from the inside of the developer storage chamber.

Next, a configuration of the light guiding member 40 as the remaining amount detection unit provided on the developer storage chamber 4*a* will be described with reference to FIG. 7 and FIG. 8. FIG. 7 is a perspective view illustrating the periphery of the light guiding member 40 seen from the outside of the developer storage chamber 4*a*. FIG. 8 is a perspective view illustrating the periphery of the light guiding member 40 seen from the inside of the developer storage chamber 4*a*.

The light guiding member 40 as the remaining amount detection unit for detecting the remaining amount of toner is disposed on the first side wall surface Wa of the developer storage chamber 4*a*. A light emitting element (light emitting unit) 71 and a light receiving element (light receiving unit) 72 provided on the apparatus main body 110 are arranged on the outside of the developer storage chamber 4*a*.

The light guiding member 40 includes a light emitting side light guiding portion 40*a* for guiding a detection light L that is emitted from the light emitting element 71 into the developer storage chamber 4*a*, and a light receiving side light guiding portion 40*b* for guiding the detection light L that has passed through the developer storage chamber 4*b* to the light receiving element 72. A developer receiving portion 41 which is a convex-shape space curved outward in the turning radius direction of the rotating shaft 31 is formed between the light emitting side light guiding portion 40*a* and the light receiving side light guiding portion 40*b*. The light emitting side light guiding portion 40*a*, the light receiving side light guiding portion 40*b*, and the developer receiving portion 41 are formed integrally.

The light emitting side light guiding portion 40*a* includes an incident portion 40*c* from which the detection light L emitted from the light emitting element 71 enters the light emitting side light guiding portion 40*a*, and a light emitting side window (light projecting window) 40*d* as a light transmission window from which the detection light L entering the light emitting side light guiding portion 40*a* is output to the developer storage chamber 4*a*. Similarly, the light receiving side light guiding portion 40*b* includes a light receiving side window (light receiving window) 40*e* as a light transmission window from which the detection light L passing through the developer storage chamber 4*a* enters the light receiving side light guiding portion 40*b*, and an output portion 40*f* from which the detection light L entering the light receiving side light guiding portion 40*b* is output to the light receiving element 72. The light emitting side window 40*d* and the light receiving side window 40*e* are arranged facing to each other, so that a light path 42 for the detection light L to pass through is formed therebetween. However, in a case where the light path 42 is formed while taking the refraction of light occurring at the time of emitting light from the light emitting side window 40*d* or the time of incoming light to the light receiving side window 40*e* into consideration, the configuration is not limited to the above configuration in which the light emitting side window 40*d* and the light receiving side window 40*e* are arranged facing to each other.

5. Light Transmission-Type Developer Remaining Amount Detection Method

Next, a light transmission-type developer remaining amount detection method using the light guiding member 40 will be described with reference to FIG. 7 through FIG. 11.

As illustrated in FIG. 7, the detection light L is emitted from the light emitting element 71 when the remaining amount of the toner within the developer storage chamber 4*a* is detected. The emitted detection light L enters the incident portion 40*c*, and is guided into the developer storage chamber 4*a* through the light emitting side window 40*d* as illustrated in FIG. 8. Then, the detection light L emitted from the light emitting side window 40*d* enters the light receiving side window 40*e* that is arranged facing thereto. At this time, the light path 42 is formed between the light emitting side window 40*d* and the light receiving side window 40*e*. Then, the detection light L that has entered the light receiving side window 40*e* is emitted to the light receiving element 72 through the output portion 40*f*, so as to be received by the light receiving element 72. Through the operation, it is detected that the detection light L has passed through the developer storage chamber 4*a*.

Figure 9:
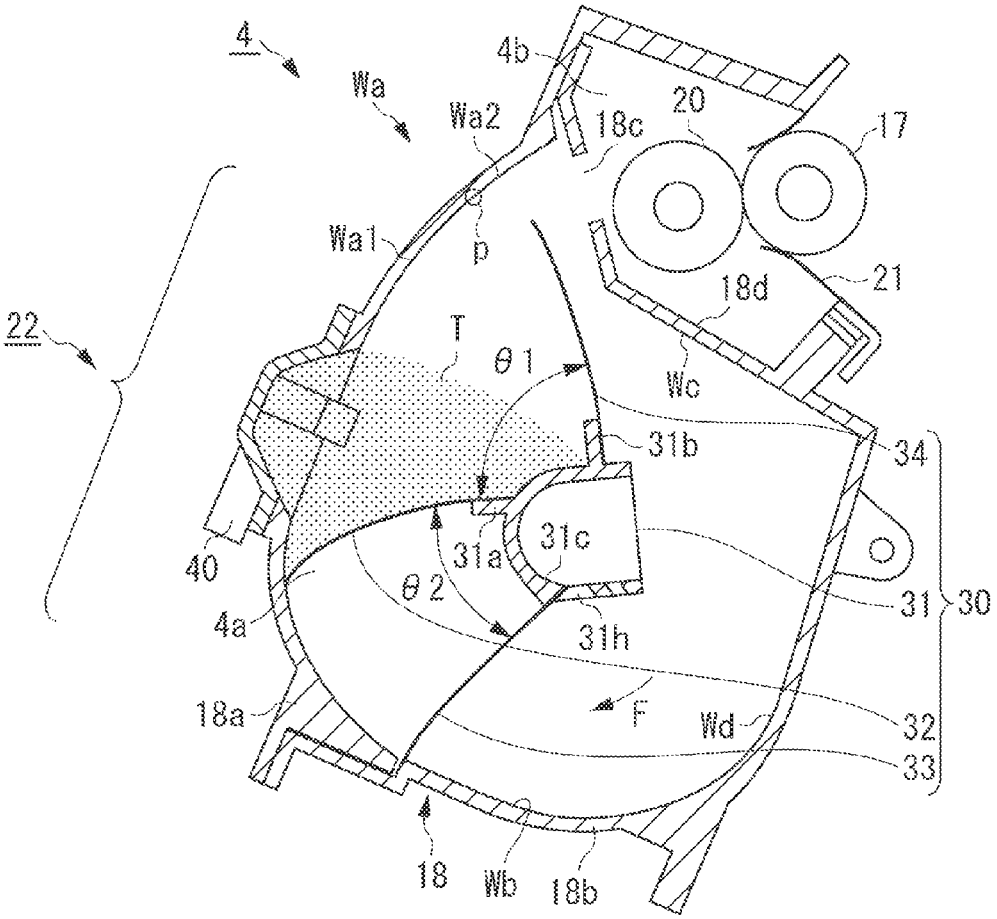
FIG. 9 is a longitudinal sectional view of the development unit illustrating an operation of light transmission-type developer remaining amount detection according to the exemplary embodiment of the present invention.
Figure 10:
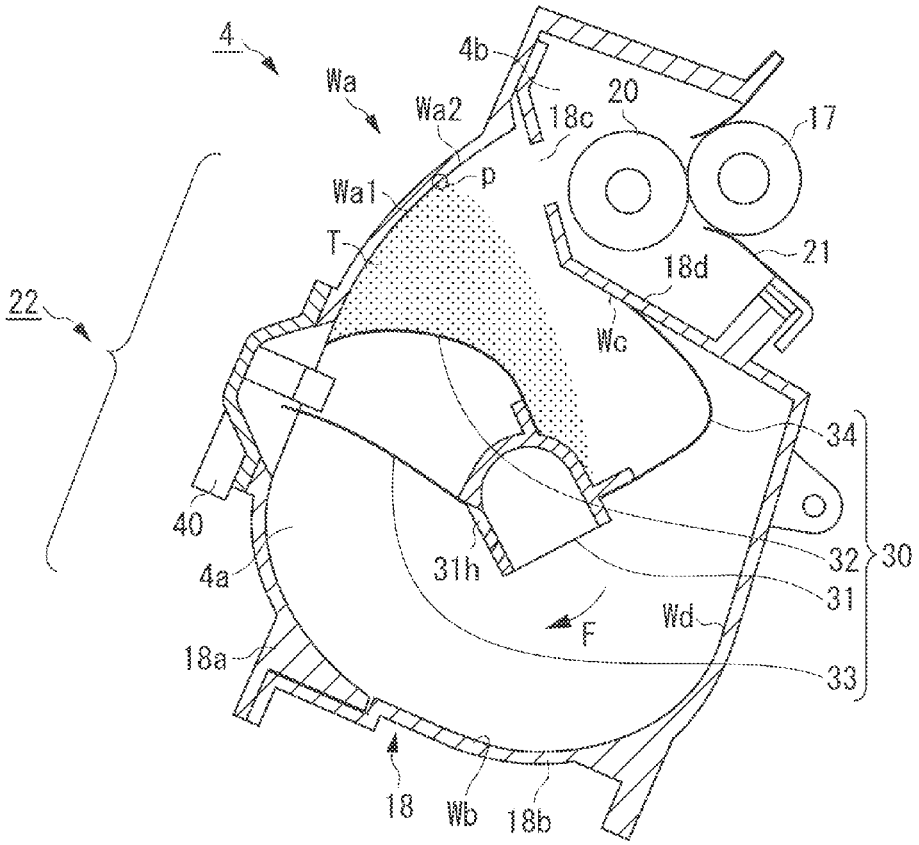
FIG. 10 is a longitudinal sectional view of the development unit illustrating an operation of the light transmission-type developer remaining amount detection according to the exemplary embodiment of the present invention.
Figure 11:
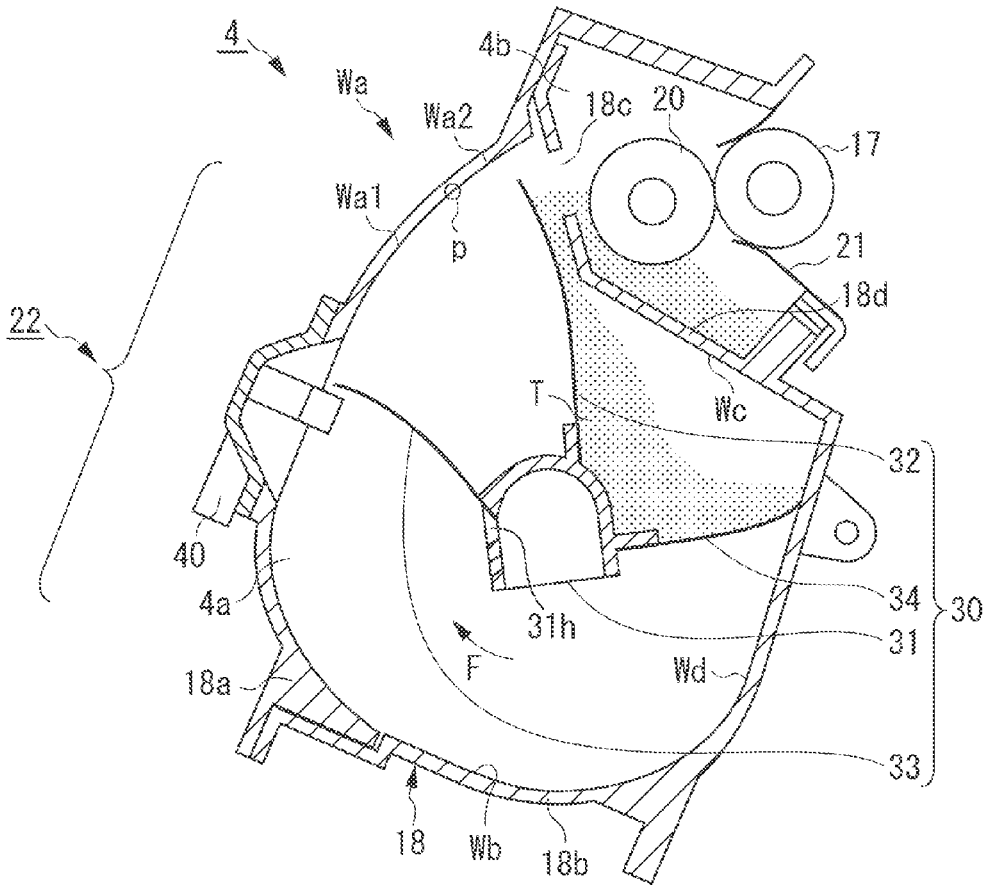
FIG. 11 is a longitudinal sectional view of the development unit illustrating an operation of the light transmission-type developer remaining amount detection according to the exemplary embodiment of the present invention.

FIG. 9 is a longitudinal sectional view of the development unit 4 illustrating a state where the toner conveyed by the conveyance member 32 passes through the light guiding member 40. FIG. 10 is a longitudinal sectional view of the development unit 4 illustrating a state immediately after the toner conveyed by the conveyance member 32 has passed through the light guiding member 40. FIG. 11 is a longitudinal sectional view of the development unit 4 illustrating a state where the toner is flipped up by the conveyance member 32.

The light path 42 is formed when the toner is not present on the light guiding member 40. However, as illustrated in FIG. 9, when the toner is passing through the light guiding member 40, the light path 42 is blocked by the toner, and thus the detection light L cannot be detected by the light receiving element 72. Then, as illustrated in FIG. 10, when the toner has passed through the light guiding member 40, the light path 42 is formed again, so that the detection light L can be detected by the light receiving element 72.

At this time, if a large amount of toner remains within the developer storage chamber 4*a*, the amount of toner passing through the light guiding member 40 is larger, and the passing time thereof is longer. Therefore, a period of time in which the light path 42 is blocked will be longer. On the other hand, if a small amount of toner remains within the developer storage chamber 4*a*, the amount of toner passing through the light guiding member 40 is also smaller, and the passing time thereof is shorter. Therefore, a period of time in which the light path 42 is blocked will be shorter.

In this manner, because the length of time in which the light receiving element 72 can receive light varies according to the remaining amount of the toner within the developer storage chamber 4*a*, the remaining amount of the toner within the developer storage chamber 4*a* can be detected from the time period in which the detection light L is blocked.

However, if the toner passes through the light guiding member 40, the toner may adhere to the light emitting side window 40*d* and the light receiving side window 40*e* to interrupt the detection light L. In such a case, the time in which the detection light L is blocked becomes longer than usual, and thus the remaining amount of the toner may not be precisely detected.

Therefore, according to the present exemplary embodiment, as illustrated in FIG. 2 and FIG. 9 through FIG. 11, the cleaning member 33 including a sheet member which wipes off the toner adhered to the light emitting side window 40*d* and the light receiving side window 40*e*, is attached to the rotating shaft 31. As illustrated in FIG. 10, in order to reduce the lowering of detection accuracy of the remaining amount of the toner caused by the adhered toner as much as possible, the cleaning member 33 is arranged at a phase where the cleaning member 33 can wipe the light emitting side window 40*d* and the light receiving side window 40*e* promptly after the conveyance member 32 conveying the toner has passed through the light guiding member 40.

In addition, the toner that is stirred by the conveyance member 32 and scattered within the developer storage chamber 4*a* may also interrupt the detection light L. This scattering toner can be one factor in lowering the detection accuracy of the remaining amount of the toner. In other words, if the conveyance member 32 conveys the toner further upward than a horizontal line that passes the rotational center of the rotating shaft 31, the toner may slip off from the surface of the conveyance member 32 due to the gravitational force and scatter within the developer storage chamber 4*a*. The toner within the developer storage chamber 4*a* may scatter due to an airflow which is generated when the deformed conveyance member 32 is restored. Particularly, as illustrated in FIG. 6, at the moment when the toner is flipped up by the conveyance member 32, the toner that has not been conveyed to the development chamber 4*b* drops down to the downstream side in the rotational direction of the rotating shaft 31, and thus a large amount of scattered toner is likely to be generated.

Therefore, according to the present exemplary embodiment, as illustrated in FIG. 2 and FIG. 9 through FIG. 11, the receiving member (scattering prevention member) 34 including a sheet member is attached to the rotating shaft 31 as a receiving portion that receives the toner falling from the conveyance member 32. The receiving member 34 is disposed on a position further on the downstream side than the conveyance member 32 in the rotational direction of the rotating shaft 31, and further on the upstream side than the light guiding member 40 in the rotational direction of the rotating shaft 31 when the cleaning member 33 has wiped the light emitting side window 40*d* and the light receiving side window 40*e*. With this configuration, the toner which falls from the conveyance member 32 to the downstream side in the rotational direction of the rotating shaft 31 can be received, so that the toner is suppressed from being scattered.

Figure 12:
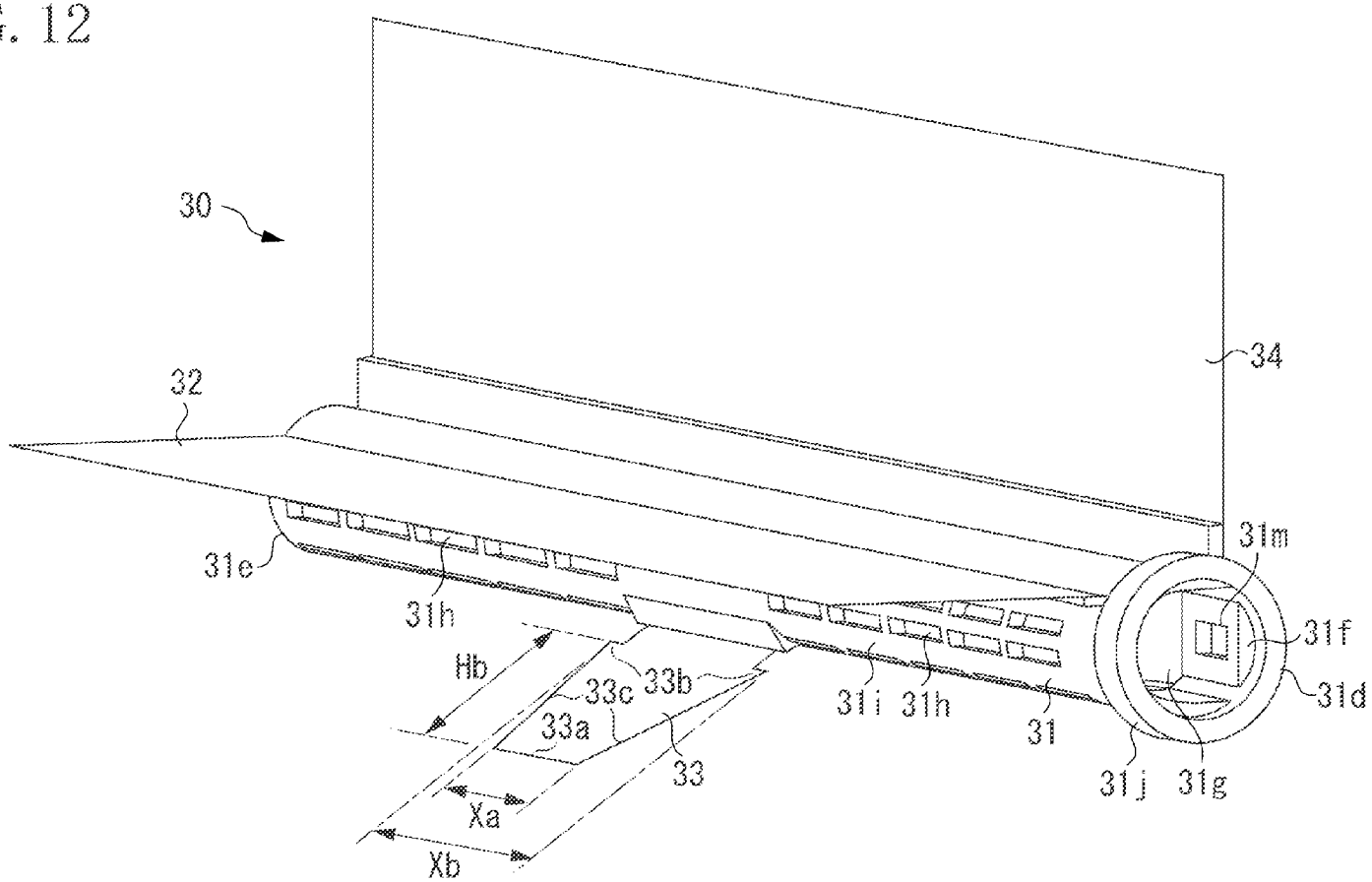
FIG. 12 is a perspective view of a conveyance unit according to the exemplary embodiment of the present invention.

The configurations of the cleaning member 33 and the receiving member 34 will be described with reference to FIG. 2 and FIG. 9 through FIG. 12. FIG. 12 is a perspective view of the rotating shaft 31 and the attachment components thereof (conveyance unit 30) according to the present exemplary embodiment.

According to the present exemplary embodiment, in a vicinity of the center in the axial direction of the rotating shaft 31, a cleaning member attachment surface 31*c* (see FIG. 2) is provided on the rotating shaft 31, at a phase (θ2) position of 30 degrees on the upstream side with respect to the conveyance member attachment surface 31*a* in the rotational direction of the rotating shaft 31. Then, the cleaning member 33 is attached on the cleaning member attachment surface 31*c*. The end portion of the cleaning member 33 on the inside in the turning radius direction of the rotating shaft 31 is attached to the rotating shaft 31. The cleaning member 33 is fixed to the rotating shaft 31 through an appropriate fixing method such as thermal caulking, ultrasonic welding, or adhesive bonding.

As illustrated in FIG. 12, the free end portion of the cleaning member 33 is an almost trapezoid-shape. In other words, in the cleaning member 33, a width Xb at an end edge 33*b* located inward by a height Hb in the turning radius direction of the rotating shaft 31 is greater than a width Xa at a leading edge 33*a* as an end portion (free end) on the outside in the turning radius direction thereof (Xa<Xb). Both of sloped side end portions 33*c* extending from the above-described leading edge 33*a* to the edge end 33*b* of the cleaning member 33 wipe off the toner adhered to the light emitting side window 40*d* and the light receiving side window 40*e* by contacting with the light emitting side window 40*d* and the light receiving side window 40*e* which are arranged facing to each other. The cleaning member 33 can be desirably produced from a flexible resin sheet such as a polyester film, or a polyphenylene sulfide film. The sheet member desirably has a thickness of 50 μm to 250 μm in order to cause the cleaning member 33 to easily enter the space between the light emitting side window 40*d* and the light receiving side window 40*e*. According to the present exemplary embodiment, as illustrated in FIG. 8, the light emitting side window 40*d* and the light receiving side window 40*e* arranged facing to each other are formed in such a manner that a separation distance w1 that is adjacent to the development storage chamber 4*a* is wider than a separation distance w2 that is far from the developer storage chamber 4*a* (i.e., w1>w2). Accordingly, the free end of the cleaning member 33 has the above-described almost trapezoid-shape so as to contact with sloped surfaces of the light emitting side window 40*d* and the light receiving side window 40*e* arranged facing to each other to rub and clean them.

On a receiving member attachment surface 31*b* provided on the outer surface of the rotating shaft 31, the receiving member 34 is attached to an almost entire region thereof in the axial direction of the rotating shaft 31 (see FIG. 2). According to the present exemplary embodiment, the receiving member attachment surface 31*b* is provided on the rotating shaft 31, at a phase (θ1) position of 90 degrees on the downstream side with respect to the conveyance member attachment surface 31*a* in the rotational direction of the rotating shaft 31. The receiving member 34 is a rectangular-shape sheet member that can be produced from a flexible resin sheet such as a polyester film, or a polycarbonate film having a thickness of equal to or less than 100 μm. The sheet member used for the above-described receiving member 34 has a lower toner conveying capacity as compared with that of the sheet member used for the conveyance member 32. The end portion of the receiving member 34 on the inside in the turning radius direction of the rotating shaft 31 is attached to the rotating shaft 31. The receiving member 34 is fixed to the rotating shaft 31 through an appropriate fixing method such as thermal caulking, ultrasonic welding, or adhesive bonding.

According to the present exemplary embodiment, the length of the receiving member 34 in the natural state in the turning radius direction of the rotating shaft 31 is equal to or shorter than the length of the conveyance member 32 in the same direction. According to the rotation of the rotating shaft 31, a leading edge 34*a* as the end portion (free end) of the receiving member 34 on the outside of the turning radius of the rotating shaft 31 moves while contacting with at least a part of the first side wall surface Wa. Then, when the rotating shaft 31 rotates further, the leading edge 34*a* of the receiving member 34 separates from the first side wall surface Wa. After that, when the rotating shaft 31 rotates further, the receiving member 34 moves while causing the leading edge 34*a* thereof to contact with the upper wall surface We as an inner wall surface of the partition wall 18*d*, the second side wall surface Wd as an inner wall surface facing to the first side wall surface Wa, and the bottom wall surface Wb. Then, the leading edge 34*a* of the receiving member 34 contacts with the regulation wall surface Wa1 of the first side wall surface Wa again. In this manner, the receiving member 34 receives the toner falling from the conveyance member 32 while contacting with the inner wall surface of the developer storage chamber 4*a*, and thus the scattering of the toner can be suppressed more effectively. As described above, when the leading edge 32*a* of the conveyance member 32 is released from the contact with the inner wall surface Wa of the developer storage chamber 4*b*, the receiving member 34 can desirably contact with the inner wall surface We of the developer storage chamber 4*a* on the downstream side of the opening portion 18*c* of the partition wall 18*d* in the rotational direction of the rotating shaft 31. At the same time, the receiving member can receive the developer falling from the conveyance member 32. Particularly, according to the present exemplary embodiment, when the cleaning member 33 passes through the detection unit 40, the receiving member 34 receives the developer falling from the conveyance member further on the downstream side than the conveyance member 32 and further on the upstream side than the detection unit 40 in the rotational direction of the rotating shaft 31.

According to the present exemplary embodiment, the receiving portion is the receiving member 34 formed of a sheet member. However, the receiving portion is not limited thereto. For example, the receiving portion may be formed of a mold member, or may be integrally formed with the rotating shaft 31. For example, a projection protruded outside in the turning radius direction of the rotating shaft 31 from an outer surface 31*i* of the rotating shaft 31 which forms the receiving member attachment surface 31*b* of the rotating shaft 31 partially includes a function as the receiving portion. As described above, the receiving portion can be formed in such a manner that the projection (the length thereof in the turning radius direction thereof may be further extended) protruded outside in the turning radius direction of the rotating shaft 31 is integrally formed with the rotating shaft 31 in the almost entire region in the longitudinal direction of the rotating shaft 31 In this case, it is desirable that the leading edge as the end portion of the receiving portion on the outside in the turning radius direction of the rotating shaft 31 does not contact with the inner wall surface of the developer storage chamber 4*a* and the light guiding member 40.

6. Filling Developer Storage Chamber with Toner

Next, a method for filling the development storage chamber 4*a* with a toner will be described with reference to FIG. 12 through FIG. 15.

FIG. 12 is a perspective view of the rotating shaft 31 and the attachment components thereof (conveyance unit 30). As illustrated in FIG. 12, an end opening portion 31*f* as an opening portion is provided on one end portion (front side end portion) 31*d* in the axial direction of the rotating shaft 31. As described below, the end opening portion 31*f* is used to bind a drive transmission gear 35 as a drive transmission member for transmitting an external driving force to the rotating shaft 31, and is also used to fill the developer storage chamber 4*a* with toner. The interior of the rotating shaft 31 forms a hollow portion 31*g* that continues from the above-described end opening portion 31*f* to another end portion (rear side end portion) 31*e* in the axial direction thereof. Accordingly, access from the end opening portion 31*f* to the rear side end portion 31*e* can be provided via the hollow portion 31*g*. According to the present exemplary embodiment, the rear side end portion 31*e* of the rotating shaft 31 is closed.

The rotating shaft 31 as a hollow-columnar member is provided with a side opening portion 31*h* as an opening portion that communicates between (penetrates through) the hollow portion 31*g* and the outer surface (outer circumferential surface, or surface) 31*i* in the turning radius direction thereof. The side opening portion 31*h* is used as a discharge port of the toner when the developer storage chamber 4*a* is filled with the toner. The arrangement of the side opening portion 31*h* will be described below further in detail.

Figure 13:
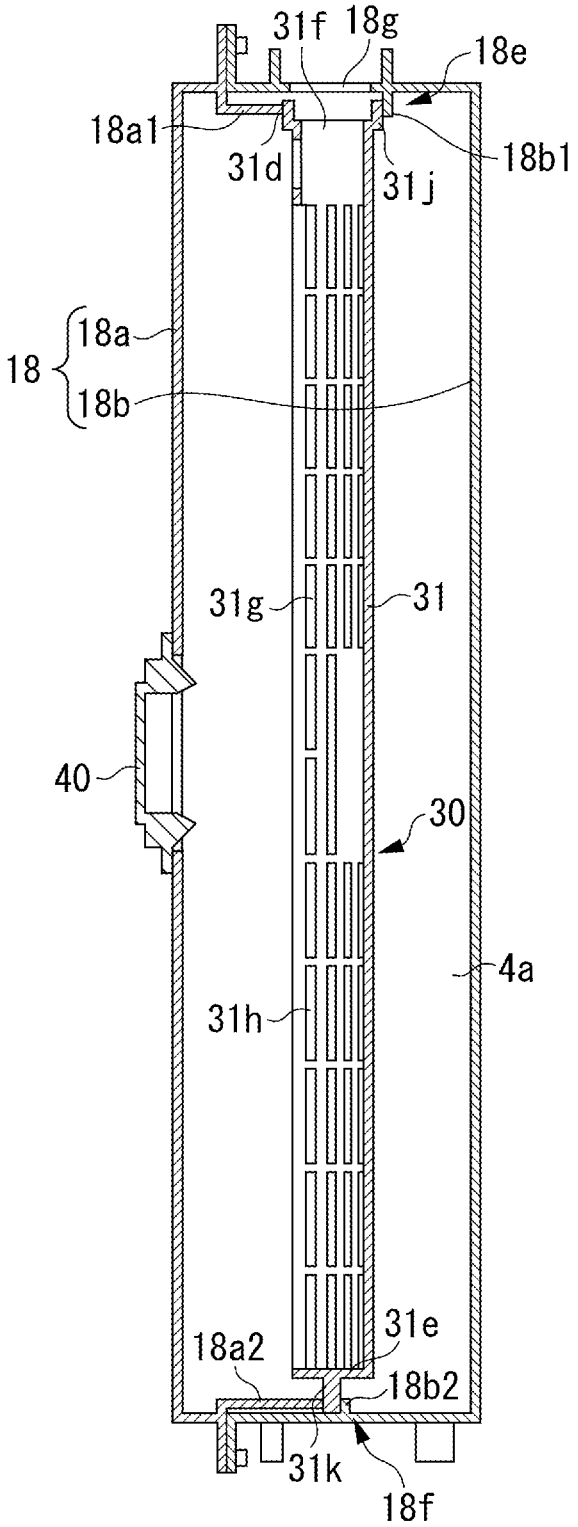
FIG. 13 is a cross-sectional view of the developer storage chamber illustrating a state where the conveyance unit is set within the developer storage chamber according to the exemplary embodiment of the present invention.

FIG. 13 is a cross-sectional view of the developer storage chamber 4*a*. FIG. 13 illustrates the interior of the developer storage chamber 4*a* in a state that the conveyance unit 30 is set to the developer storage chamber 4*a*. In FIG. 13, the conveyance member 32, the cleaning member 33, and the receiving member 34 are omitted from the illustration.

According to the present exemplary embodiment, the development frame 18 is formed by combining a plurality of divided frames. Particularly, according to the present exemplary embodiment, the development frame 18 is formed by combining the frames divided into a first development frame 18*a* and a second development frame 18*b* through an appropriate fixing method such as ultrasonic welding. According to the present exemplary embodiment, the first development frame 18*a* and the second development frame 18*b* are divided on both sides of a plane that passes through almost the rotational center of the rotating shaft 31 to extend in the vertical direction in the orientation in which the process cartridge 7 is mounted on the apparatus main body 110. Then, the frame to which the light guiding member 40 is attached and which is provided on the opposite side of the photosensitive member unit 13 than the plane is referred to as the first development frame 18*a*, whereas the frame provided on the side of the photosensitive member unit 13 than the plane is referred to as the second development frame 18*b* (also see FIG. 2).

On the front side end portion 31*d* of the rotating shaft 31, a front side support receiving portion 31*j* having an almost columnar-shape outer circumferential surface is formed, and on the rear side end portion 31*e* thereof, a rear side support receiving portion 31*k* having an almost columnar-shape outer circumferential surface is formed. In the developer storage chamber 4*a*, the front side support receiving portion 31*j* and the rear side support receiving portion 31*k* are respectively supported by a front side bearing portion 18*e* and a rear side bearing portion 18*f* which are formed by combining the first development frame 18*a* and the second development frame 18*b*. The front side bearing portion 18*e* is formed of bearing pieces 18*a*1 and 18*b*1 which are respectively provided on the first development frame 18*a* and the second development frame 18*b* on the side of the front side end portion 31*d* of the rotating shaft 31. The rear side bearing portion 18*f* is formed of bearing pieces 18*a*2 and 18*b*2 which are respectively provided on the first development frame 18*a* and the second development frame 18*b* on the side of the rear side end portion 31*e* of the rotating shaft 31.

A filling port 18*g* as a through hole which communicates between the outside and the interior of the development storage chamber 4*a* is formed on the second development frame 18*b*. The end opening portion 31*f* overlaps with the filling port 18*g* as a through hole when seen in the axial direction of the rotating shaft 31. In other words, in the developer storage chamber 4*a*, the rotating shaft 31 is arranged so as to be overlapped with the filling port 18*g* of the second development frame 18*b* when seen in the axial direction thereof. Accordingly, the rear side end portion 31*e* of the rotating shaft 31 can be seen from the filling port 18*g*.

Figure 14A:
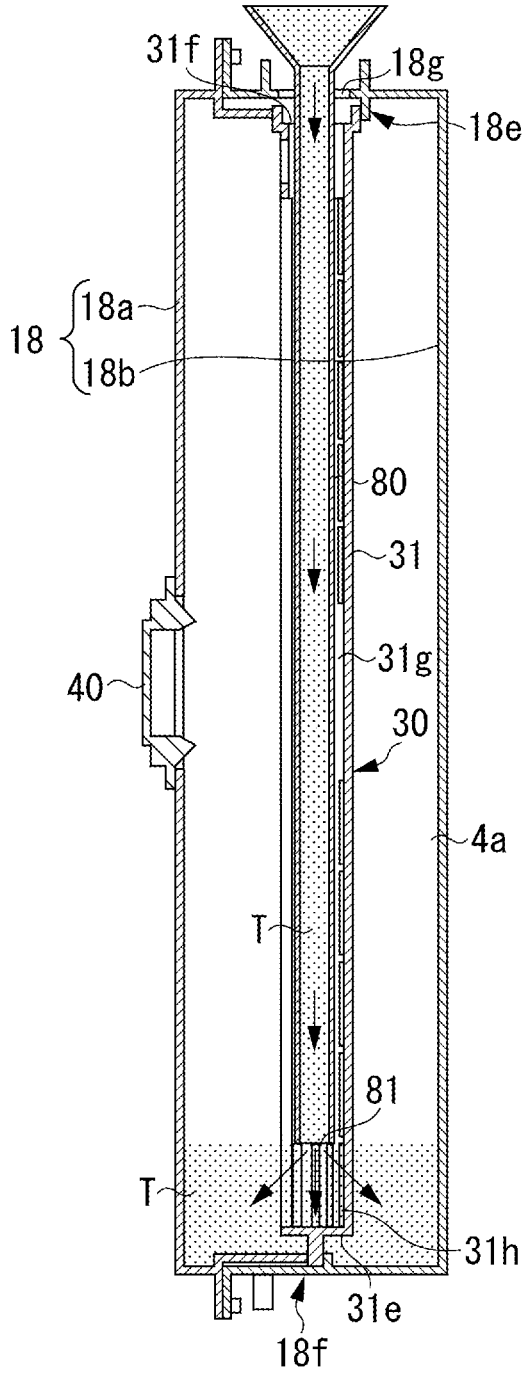
FIGS. 14A and 14B are cross-sectional views of the developer storage chamber illustrating a state where the developer storage chamber is filled with a toner according to the exemplary embodiment of the present invention.
Figure 14B:
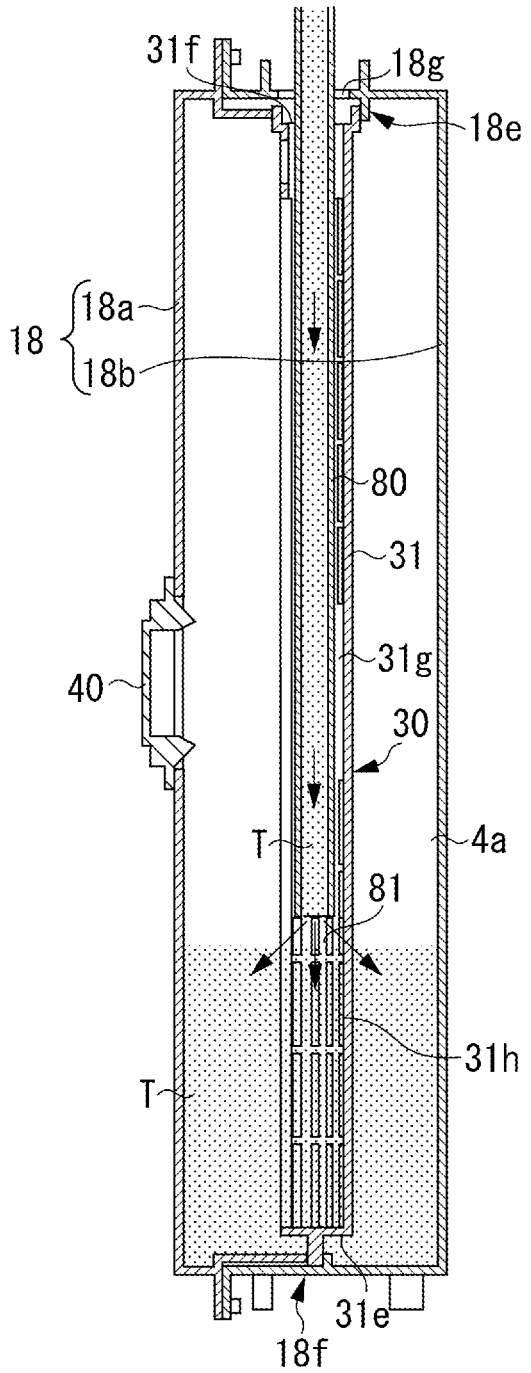

FIGS. 14A and 14B are cross-sectional views of the developer storage chamber 4*a* illustrating a state where the developer storage chamber 4*a* is filled with a toner.

As illustrated in FIGS. 14A and 14B, when the developer storage chamber 4*a* is filled with a toner, the development frame 18 is placed in a standing position so that the filling port 18*g* faces upward. Then, a nozzle 80 of a filling device is inserted from the filling port 18*g* of the development frame 18 to the hollow portion 31*g* of the rotating shaft 31 via the end opening portion 31*f* of the rotating shaft 31. In a state where the nozzle 80 is inserted into the hollow portion 31*g* to cause an outlet 81 of the nozzle 80 at an end portion (leading edge) in the axial direction (longitudinal direction) to be arranged in a vicinity of the rear side end portion 31*e* of the rotating shaft 31, filling of the toner is started. With this operation, the toner is discharged from the outlet 81 of the nozzle 80 to the hollow portion 31*g* to pass through the side opening portion 31*h* of the rotating shaft 31, so that the developer storage chamber 4*a* is filled with the toner. At this time, it is possible to fill the toner efficiently if the filling operation is executed while gradually pulling up the nozzle 80 according to the elevation of an upper surface (agent surface) of aggregation of the toner. After a predetermined amount of toner is supplied thereto, the nozzle 80 is pulled out from the filling port 18*g* via the side opening portion 31*f* of the rotating shaft 31. With the above operation, filling of the toner into the developer storage chamber 4*a* is completed.

Figure 15:
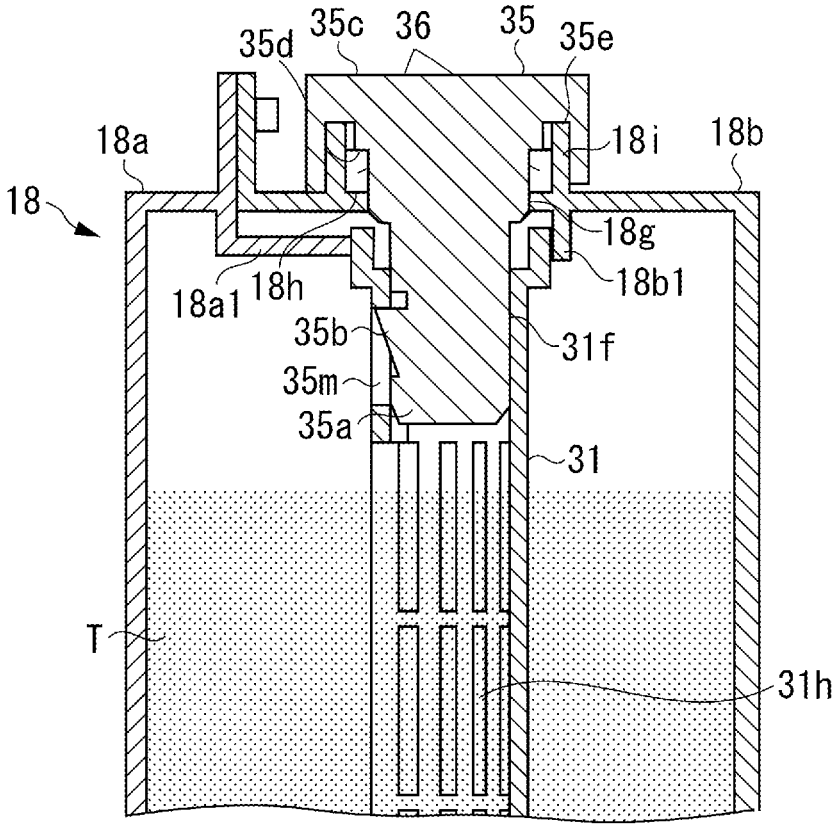
FIG. 15 is an enlarged cross-sectional view of the developer storage chamber illustrating a state where a drive transmission gear according to the exemplary embodiment of the present invention is mounted on the development unit.

FIG. 15 is an enlarged cross-sectional view of the periphery of the developer storage chamber 4*a* illustrating a state where the drive transmission gear 35 is mounted thereon.

After the above-described filling operation of toner has been completed, an almost columnar-shape combining portion 35*a* of the drive transmission gear 35 is inserted into the side opening portion 31*f* of the rotating shaft 31 via the filling port 18*g* of the development frame 18. Accordingly, an engaging portion (projection) 35*b* provided on the combining portion 35*a* and a latching portion (hole) 31*m* provided on the rotating shaft 31 are engaged (snap-fit), the drive transmission gear 35 is combined with the rotating shaft 31, and thus the driving force can be transmitted to the conveyance unit 30.

Before the drive transmission gear 35 is inserted into the rotating shaft 31, a sealing member 36 is arranged between a surrounding surface 18*h* of the filling port 18*g* of the second development frame 18*b* and a surface 35*d* of a gear portion 35*c* of the drive transmission gear 35 on the side of the second development frame 18*b*. According to the present exemplary embodiment, the sealing member 36 is formed of an elastic member such as a sponge. Further, according to the present exemplary embodiment, the sealing member 36 has an almost disc-shape, and provides a sealing in the radius direction by contacting with an outer circumferential surface of the combining portion 35*a* of the drive transmission gear 35, in addition to providing a planar sealing by contacting with the above-described surfaces 18*h* and 35*d*. In this manner, the filling port 18*g* can be sealed by placing the sealing member 36 between the drive transmission gear 35 and the second development frame 18*b*.

A groove 35*e* of the drive transmission gear 35 which is formed on the gear portion 35*c* on the side of the second development frame 18*b* is slidably engaged with an engagement portion 18*i* which is an almost columnar-shape protrusion provided to surround the filling port 18*g* of the second development frame 18*b*. With this configuration, the rotational center of the drive transmission gear 35 is fixed.

As described above, according to the present exemplary embodiment, filling of the toner can be performed without using a dedicated filling port or a dedicated sealing member separately, and the filling port can be sealed with the existing sealing member for sealing a space between the drive transmission gear and the development frame. Therefore, the number of components and the number of steps in assembly processing can be reduced.

Generally, in order to increase the filling rate, it is efficient if the developer is gently filled from the rear side area seen from the filling port to minimize the air contained in the developer when the developer storage chamber is filled with the developer.

Accordingly, in a case where the developer is filled into the developer storage chamber via the hollow portion of the conveyance unit, the hollow portion is desirably continued from the front side area to the rear side area seen from the filling port in terms of convenience in filling operation because the nozzle of the filling device can be inserted up to the rear end thereof. In this case, in order to discharge the developer to the developer storage chamber from the follow portion, it is desirable that the rotating shaft is provided with a discharge port that communicates between the hollow portion and the outer surface in the turning radius direction thereof.

However, if the above-described receiving portion for suppressing the scattering developer is provided on the rotating shaft provided with the above-described discharge port, the developer received by the receiving portion reaches a region on the side of the remaining amount detection unit via the discharge port provided on the rotating shaft, and thus the detection accuracy of the developer remaining amount may be deteriorated. Therefore, it is more desirable that the side opening portion 31*h* of the rotating shaft 31 is provided further on the downstream side than the receiving member 34 and further on the upstream side than the conveyance member 32 in the rotational direction of the rotating shaft 31, and is not provided further on the downstream side than the conveyance member 32 and further on the upstream side than the receiving member 34.

7. Arrangement of Side Opening Portion

Next, an influence on the detection accuracy of the remaining amount of the toner which may arise if a method of supplying the toner via the hollow portion 31*g* of the conveyance unit 30 is employed will be described.

Figure 16:
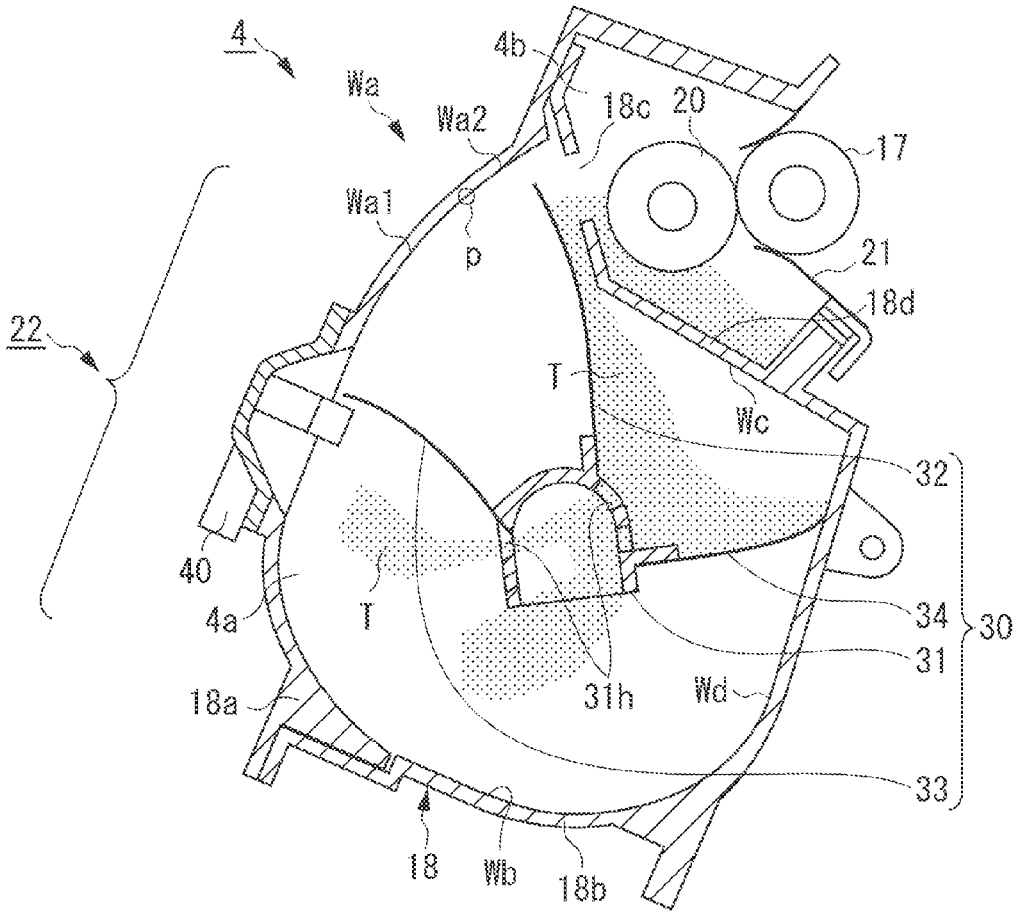
FIG. 16 is a longitudinal sectional view of a comparison example of the development unit.

FIG. 16 is a longitudinal sectional view of a comparison example of the development unit illustrating the effect of the present exemplary embodiment. The comparison example of the development unit includes substantially the same configuration as that of the development unit 4 according to the present exemplary embodiment except for the point particularly described below. In the descriptions of the comparison example, the same reference numerals are applied to the elements having the same or corresponding functions as those according to the present exemplary embodiment.

In the comparison example of the development unit 4 illustrated in FIG. 16, the side opening portions 31*h* are provided on the outer surface 31*i* of the rotating shaft 31 of the conveyance unit 30, on the almost entire region in the rotational direction of the rotating shaft 31. In this comparison example, as illustrated in FIG. 16, the side opening portions 31*h* are not provided on a region between the cleaning member 33 and the conveyance member 32 in the rotational direction and the axial direction of the rotating shaft 31.

As described above, in order to suppress the toner from scattering within the developer storage chamber 4*a*, the receiving member 34 is attached to the rotating shaft 31. However, in the comparison example illustrated in FIG. 16, because the side opening portions 31*h* are provided on the almost entire region of the outer surface 31*i* in the rotational direction of the rotating shaft 31, the toner received by the receiving member 34 passes through the side opening portions 31*h* and the hollow portion 31*g*. Then, the passed toner or a toner scattered by a fall of the passed toner may reach the light guiding member 40. Therefore, there is a possibility in that such toner interrupts the detection light L and deteriorates the detection accuracy of the remaining amount of the toner.

Therefore, according to the present exemplary embodiment, as illustrated in FIG. 11 and FIG. 12, on the rotating shaft 31, the side opening portions 31*h* are not provided further on the downstream side than the conveyance member 32, and on the outer surface 31*i* further on the upstream side than the receiving member 34 in the rotational direction of the rotating shaft 31. In other words, in the rotational direction of the rotating shaft 31, the side opening portions 31*h* are not provided on the phase between the conveyance member 32 and the receiving member 34.

Then, the side opening portions 31*h* are only provided further on the downstream side than the receiving member 34, and on the outer surface 31*i* further on the upstream side than the conveyance member 32 in the rotational direction of the rotating shaft 31. According to the present exemplary embodiment, the side opening portions 31*h* are provided on the almost entire region of the outer surface 31*i* in the axial direction of the rotating shaft 31. According to the present exemplary embodiment, as illustrated in FIG. 12, although the side opening portions 31*h* are not provided on a region between the cleaning member 33 and the conveyance member 32 in the rotational direction and the axial direction of the rotating shaft 31, the side opening portions 31*h* may be provided on that region.

More specifically, according to the present exemplary embodiment, a plurality of side opening portions 31*h* divided and arranged in a grid state in the axial direction and the rotational direction of the rotating shaft 31 is formed on the above-described predetermined region on the outer surface 31*i* of the rotating shaft 31. According to the present exemplary embodiment, each of the plurality of the side opening portions 31*h* arranged in both of the axial direction and the rotational direction of the rotating shaft 31 is an oblong hole that is longer in the axial direction of the rotating shaft 31. However, the shape and the number of the side opening portion 31*h* can be arbitrarily selected according to easiness in filling of toner, and strength required for the rotating shaft 31.

As illustrated in FIG. 11 and FIG. 13, according to the present exemplary embodiment, the rotating shaft 31 includes the outer surface of which cross-sectional surface in a direction almost orthogonal to the axial direction thereof has an almost U-shape. The conveyance member attachment surface 31*a* to which the conveyance member 32 is attached is arranged on a bottom side of the outer surface of the rotating shaft 31 having the almost U-shape cross-sectional surface. Then, one side of the outer surface of the rotating shaft 31 having the almost U-shape cross-sectional face, which is the opposite side of the bottom side, is open across the almost entire region in the axial direction of the rotating shaft 31. According to the present exemplary embodiment, this opening portion also functions as the side opening portion 31*h* which communicates between the hollow portion 31*g* and the outer surface 31*i*. The side opening portion 31*h* in this region may be also formed into the above-described grid state by being divided into a plurality of openings.

With this configuration, as illustrated in FIG. 11, the toner that is received by the receiving member 34 can be prevented from passing through the interior of the rotating shaft 31. Therefore, such a passed toner or a toner scattered by a fall of the passed toner can be prevented from reaching the light guiding member 40. Accordingly, it is possible to suppress the toner from interrupting the detection light L and deteriorating the detection accuracy of the remaining amount of the toner.

As described above, according to the present exemplary embodiment, the developer storage chamber 4*a* is filled with a developer via the interior of the conveyance unit 30. With this configuration, filling of the toner can be performed without providing a dedicated filling port or a dedicated sealing member separately, and the filling port 18*g* can be sealed with the existing sealing member 36 for sealing a space between the drive transmission gear 35 and the development frame 18. Therefore, the number of components and the number of steps in assembly processing can be reduced. Further, according to the present exemplary embodiment, the side opening portions 31*h* are not provided on the region between the conveyance member 32 and the receiving member 34 in the rotational direction of the rotating shaft 31. With this configuration, it is possible to suppress the deterioration of detection accuracy of the developer remaining amount. Accordingly, the present exemplary embodiment enables the filling of the developer via the interior of the rotating shaft arranged within the developer storage chamber while suppressing the deterioration of the detection accuracy of the remaining amount of the toner.

Although the present invention has been described based on the specific exemplary embodiment, the present invention is not limited to the above-described exemplary embodiment.

For example, the present invention is not limited to an intermediate transfer-type image forming apparatus, but also applicable to a direct transfer-type image forming apparatus. In place of the intermediate transfer member used in the intermediate transfer-type image forming apparatus, the direct transfer-type image forming apparatus includes a recording material bearing member such as an endless belt that carries and conveys a recording material. Then, a toner image formed on a photosensitive member is directly transferred to the recording material that is carried and conveyed by the recording material bearing member.

In addition, the electrophotographic image forming apparatus is not limited to an in-line type electrophotographic image forming apparatus. For example, there is provided an image forming apparatus including a plurality of development devices provided to a single photosensitive member. In such an image forming apparatus, electrostatic images sequentially formed on the photosensitive member are separately developed by switching the plurality of the development devices, and each of the toner images is sequentially transferred to a recording material placed on the intermediate transfer member or the recording material bearing member. The present invention is also applicable to such an image forming apparatus.

Further, the electrophotographic image forming apparatus is not limited to a color image forming apparatus, but also applicable to a single color (monochromatic) image forming apparatus.

In addition, the developer storage unit may be formed into a cartridge to be configured as a developer cartridge that is detachably mounted to the apparatus main body of the electrophotographic image forming apparatus. This developer cartridge is used as a cartridge for replenishing the electrophotographic image forming apparatus with the developer.

Furthermore, the development device including the developer storage unit may be formed into a cartridge to be configured as a developer cartridge that is detachably mounted to the apparatus main body of the electrophotographic image forming apparatus.

In addition, the present invention is applicable even in a case where the developer storage unit or the development device is substantially fixed to the electrophotographic image forming apparatus and cannot be replaced easily.

According to the present invention, the developer can be filled into the developer storage chamber via the interior of the rotating shaft provided therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-207519 filed Sep. 20, 2012, which is hereby incorporated by reference herein in its entirety.

What is claimed is:

1. A developer storage unit to be used in an electrophotographic image forming apparatus, the developer storage unit comprising:

a frame configured to form a developer storage chamber for storing a developer, having a through hole which communicates between an outside and an interior of the developer storage chamber;

a rotating shaft which is provided on the interior of the developer storage chamber in a rotatable manner and includes a hollow portion formed in an interior thereof, an end opening portion provided on an end portion in an axial direction thereof, and a side opening portion communicating between the hollow portion and an outside surface thereof in a turning radius direction thereof, wherein the hollow portion is continued from the end opening portion to an end portion on another side in the axial direction of the rotating shaft, and provided so as to be overlapped with the through hole of the frame in a case which is seen from the axial direction of the rotating shaft;

a drive transmission member which is inserted to the end opening portion of the rotating shaft through the through hole of the frame from an outside of the frame, and configured to transmit a driving force to the rotating shaft;

a detection unit which is provided on an inner wall surface of the developer storage chamber arranged on an outside in the turning radius direction of the rotating shaft, and configured to detect an amount of a developer in the interior of the developer storage chamber;

a conveyance member which is provided on the rotating shaft, and configured to stir and convey the developer stored in the developer storage chamber by rotation of the rotating shaft; and a receiving portion which is provided on the rotating shaft, and configured to receive a developer falling from the conveyance member on a downstream side than the conveyance member and on an upstream side than the detection unit in the rotational direction of the rotating shaft by rotation of the rotating shaft;

wherein the side opening portion of the rotating shaft is provided on a downstream side than the receiving portion and on an upstream side than the conveyance member in the rotational direction of the rotating shaft, and is not provided on the downstream side than the conveyance member and on an upstream side than the receiving portion;

wherein any other openings are not provided on an upstream side of the receiving portion and on a downstream side of the conveyance member in the rotational direction of the rotating shaft.

2. The developer storage unit according to claim 1, wherein the conveyance member conveys a developer while its leading edge as an end portion on an outside in the turning radius direction of the rotating shaft deforms by contacting with the inner wall surface of the developer storage chamber by rotation of the rotating shaft, and flips up the developer toward an opening portion provided on a partition wall between the developer storage chamber and a supply target of a developer from the developer storage chamber by an elastic restoration force when contact thereof is released.

3. The developer storage unit according to claim 2, wherein, when the leading edge of the conveyance member is released from contact with the inner wall surface of the developer storage chamber, the receiving portion contacts with the inner wall surface of the developer storage chamber and receives the developer falling from the conveyance member on a downstream side of the opening portion of the partition wall in the rotational direction of the rotating shaft.

4. The developer storage unit according to claim 2, wherein the detection unit is provided on the inner wall surface of the developer storage chamber on an upstream side than the opening portion of the partition wall and on a downstream side than a bottom wall surface of the developer storage chamber in the rotational direction of the rotating shaft.

5. The developer storage unit according to claim 1, wherein the conveyance member is a flexible sheet member.

6. The developer storage unit according to claim 1, wherein the receiving portion is a flexible sheet member.

7. The developer storage unit according to claim 1, wherein the detection unit is a light guiding member configured to pass detection light for detecting an amount of a developer in the interior of the developer storage chamber through the interior of the developer storage chamber.

8. The developer storage unit according to claim 7, wherein the light guiding member includes a light emitting side window for projecting the detection light to the interior of the developer storage chamber and a light receiving side window for receiving the detection light passing through the interior of the developer storage chamber, and the light emitting side window and the light receiving side window are arranged facing to each other along the axial direction of the rotating shaft.

9. The developer storage unit according to claim 1 further comprising a cleaning member which is provided on the rotating shaft, and configured to rub the detection unit by rotation of the rotating shaft.

10. The developer storage unit according to claim 9, wherein the cleaning member is a flexible sheet member.

11. The developer storage unit according to claim 9, wherein the receiving portion receives a developer falling from the conveyance member on the downstream side than the conveyance member and on the upstream side than the detection unit in the rotational direction of the rotating shaft when the cleaning member passes through the detection unit.

12. The developer storage unit according to claim 1, wherein the supply target of the developer from the developer storage chamber is arranged on an upper side of the developer storage chamber.

13. A development device to be used in an electrophotographic image forming apparatus, the development device comprising:

a developer carrying member configured to carry and convey a developer for developing an electrostatic image formed on an electrophotographic photosensitive member;

a development chamber including the developer carrying member; and a developer storage unit according to claim 1 which is configured to store a developer to be supplied to the development chamber.

14. A process cartridge detachably mounted to an apparatus main body of an electrophotographic image forming apparatus, the process cartridge comprising:

an electrophotographic photosensitive member; and a development device according to claim 13.

15. An electrophotographic image forming apparatus capable of forming an image on a recording material, the electrophotographic image forming apparatus comprising:

an electrophotographic photosensitive member; and a development device according to claim 13.

16. An electrophotographic image forming apparatus capable of forming an image on a recording material, the electrophotographic image forming apparatus comprising:

a process cartridge according to claim 14 detachably mounted on an apparatus main body.

17. A developer storage unit comprising:

a frame configured to form a developer storage chamber for storing a developer;

a rotating shaft which is provided on an interior of the developer storage chamber in a rotatable manner and includes a hollow portion formed in an interior thereof and a side opening communicating between the hollow portion and an outside surface thereof in a turning radius direction thereof;

a detection unit which is provided on an inner wall surface of the developer storage chamber arranged on an outside the turning radius of the rotating shaft, and configured to detect an amount of a developer in the interior of the developer storage chamber;

a conveyance member which is provided on the rotating shaft, and configured to stir and convey the developer stored in the developer storage chamber by rotation of the rotating shaft; and a receiving portion which is provided on the rotating shaft, and configured to receive a developer falling from the conveyance member; and a drive transmission member, inserted through an end opening portion of the rotating shaft from outside of the frame, and configured to transmit a driving force to the rotating shaft, wherein the side opening is provided on a downstream side of the receiving portion and on an upstream side of the conveyance member in the rotational direction of the rotating shaft, and wherein any other side openings are not provided on an upstream side of the receiving portion and on a downstream side of the conveyance member in the rotational direction of the rotating shaft.

18. The developer storage unit according to claim 17, wherein the conveyance member conveys a developer while its leading edge as an end portion on an outside in the turning radius direction of the rotating shaft deforms by contacting with the inner wall surface of the developer storage chamber by rotation of the rotating shaft, and flips up the developer toward an opening portion provided on a partition wall between the developer storage chamber and a supply target of a developer from the developer storage chamber by an elastic restoration force when contact thereof is released.

19. The developer storage unit according to claim 18, wherein, when the leading edge of the conveyance member is released from contact with the inner wall surface of the developer storage chamber, the receiving portion contacts with the inner wall surface of the developer storage chamber and receives the developer falling from the conveyance member on a downstream side of the opening portion of the partition wall in the rotational direction of the rotating shaft.

20. The developer storage unit according to claim 18, wherein the detection unit is provided on the inner wall surface of the developer storage chamber on an upstream side than the opening portion of the partition wall and on a downstream side than a bottom wall surface of the developer storage chamber in the rotational direction of the rotating shaft.

21. The developer storage unit according to claim 17, wherein the conveyance member is a flexible sheet member.

22. The developer storage unit according to claim 17, wherein the receiving portion is a flexible sheet member.

23. The developer storage unit according to claim 17, wherein the detection unit is a light guiding member configured to pass detection light for detecting an amount of a developer in the interior of the developer storage chamber through the interior of the developer storage chamber.

24. The developer storage unit according to claim 23, wherein the light guiding member includes a light emitting side window for projecting the detection light to the interior of the developer storage chamber and a light receiving side window for receiving the detection light passing through the interior of the developer storage chamber, and the light emitting side window and the light receiving side window are arranged facing to each other along the axial direction of the rotating shaft.

25. The developer storage unit according to claim 17 further comprising a cleaning member which is provided on the rotating shaft, and configured to rub the detection unit by rotation of the rotating shaft.

26. The developer storage unit according to claim 25, wherein the cleaning member is a flexible sheet member.

27. The developer storage unit according to claim 25, wherein the receiving portion receives a developer falling from the conveyance member on the downstream side than the conveyance member and on the upstream side than the detection unit in the rotational direction of the rotating shaft when the cleaning member passes through the detection unit.

28. The developer storage unit according to claim 17, wherein the supply target of the developer from the developer storage chamber is arranged on an upper side of the developer storage chamber.

29. A development device to be used in an electrophotographic image forming apparatus, the development device comprising:

a developer carrying member configured to carry and convey a developer for developing an electrostatic image formed on an electrophotographic photosensitive member;

a development chamber including the developer carrying member; and a developer storage unit according to claim 17 which is configured to store a developer to be supplied to the development chamber.

30. A process cartridge detachably mounted to an apparatus main body of an electrophotographic image forming apparatus, the process cartridge comprising:

an electrophotographic photosensitive member; and a development device according to claim 29.

31. An electrophotographic image forming apparatus capable of forming an image on a recording material, the electrophotographic image forming apparatus comprising:

an electrophotographic photosensitive member; and a development device according to claim 29.

32. An electrophotographic image forming apparatus capable of forming an image on a recording material, the electrophotographic image forming apparatus comprising:

a process cartridge according to claim 30 detachably mounted on an apparatus main body.

* * * * *